US007980184B2

(12) United States Patent
Olvey

(10) Patent No.: US 7,980,184 B2
(45) Date of Patent: Jul. 19, 2011

(54) FOLDABLY CONSTRUCTED FORCE-RESISTING STRUCTURES HAVING INTERIOR VERTICAL SUPPORT RIBS

(76) Inventor: Douglas A. Olvey, Longwood, FL (US)

( * ) Notice: Subject to any disclaimer, the term of this patent is extended or adjusted under 35 U.S.C. 154(b) by 1165 days.

(21) Appl. No.: 11/369,177

(22) Filed: Mar. 6, 2006

(65) Prior Publication Data

US 2006/0248855 A1 Nov. 9, 2006

Related U.S. Application Data

(60) Provisional application No. 60/658,498, filed on Mar. 4, 2005.

(51) Int. Cl.
*B65D 19/00* (2006.01)
*B65D 19/12* (2006.01)
*E04C 2/32* (2006.01)

(52) U.S. Cl. ..... 108/51.3; 108/56.1; 52/783.14; 206/386; 206/600; 248/346.02

(58) Field of Classification Search ..... 52/783.1, 52/783.11, 783.14, 790.1, 798.1; 248/346, 248/346.02; 108/51.3, 56.1, 57.18, 51.11; 206/386, 595, 596, 598, 599, 600; 220/62
See application file for complete search history.

(56) References Cited

U.S. PATENT DOCUMENTS

| | | | | |
|---|---|---|---|---|
| 2,576,715 A | | 11/1951 | Ferrell | |
| 2,630,605 A | * | 3/1953 | Hobson et al. | 52/291 |
| 2,908,464 A | * | 10/1959 | Traudt et al. | 108/51.3 |
| 3,000,603 A | | 9/1961 | Hemann | 108/51.3 |
| 3,216,376 A | | 11/1965 | Anderson et al. | 108/51.3 |
| 3,302,593 A | * | 2/1967 | Roberts | 108/51.3 |
| 3,952,672 A | * | 4/1976 | Gordon et al. | 108/51.3 |
| 4,100,859 A | | 7/1978 | Clark, Jr. | |
| 4,747,245 A | * | 5/1988 | Lesmeister et al. | 52/309.7 |
| 4,843,780 A | * | 7/1989 | Krings | 52/783.14 |
| 4,875,419 A | * | 10/1989 | Helton et al. | 108/56.1 |
| 5,285,732 A | | 2/1994 | Gottlieb | 108/51.3 |

(Continued)

FOREIGN PATENT DOCUMENTS

EP 741084 11/1996

(Continued)

OTHER PUBLICATIONS

U.S. Appl. No. 11/368,217.

*Primary Examiner* — Eileen Lillis
*Assistant Examiner* — Ryan D Kwiecinski
(74) *Attorney, Agent, or Firm* — Wisner & Associates

(57) ABSTRACT

A foldably constructed force-resisting structure comprises a top member and a bottom member foldably constructed and assembled from one or more blanks of sheet material, preferably corrugated paperboard, initially in a flat condition. The top member includes a base panel and at least one side portion folded downwardly from the base panel. The bottom member includes a base panel and at least one side portion folded upwardly from the base panel. The top and bottom members are assembled in nested relation to define an interior of the force-resisting structure between the base panels, which are at least substantially parallel to one another. The force-resisting structure includes a vertical support rib structure in the interior defining an X-shaped or cross-shaped configuration. The support rib structure is foldably constructed from the top member base panel and/or the bottom member base panel and provides vertical support for a load disposed on the base panel of the top member.

8 Claims, 18 Drawing Sheets

U.S. PATENT DOCUMENTS

| | | | | |
|---|---|---|---|---|
| 5,355,812 | A * | 10/1994 | Kilpatrick et al. | 108/51.3 |
| 5,448,956 | A | 9/1995 | Ong et al. | |
| 5,655,351 | A * | 8/1997 | Pohl et al. | 52/784.15 |
| 5,784,971 | A | 7/1998 | Chang | |
| 6,029,582 | A * | 2/2000 | Ogilvie et al. | 108/51.3 |
| 6,173,658 | B1 | 1/2001 | Moberg | |
| 6,976,602 | B1 * | 12/2005 | Maxwell | 220/6 |
| 7,007,613 | B2 * | 3/2006 | Sketo | 108/51.3 |
| 7,234,402 | B2 * | 6/2007 | Olvey et al. | 108/51.3 |
| 7,426,890 | B2 * | 9/2008 | Olvey | 108/51.3 |
| 2002/0069796 | A1 * | 6/2002 | Olvey et al. | 108/56.1 |
| 2006/0248855 | A1 | 11/2006 | Olvey | |

FOREIGN PATENT DOCUMENTS

| | | |
|---|---|---|
| GB | 2397568 | 7/2004 |

* cited by examiner

FOLDABLY CONSTRUCTED FORCE-RESISTING STRUCTURES HAVING INTERIOR VERTICAL SUPPORT RIBS

CROSS-REFERENCE TO RELATED PATENT APPLICATION

The subject patent application claims priority from prior U.S. Provisional Patent Application Ser. No. 60/658,498 filed Mar. 4, 2005, the entire disclosure of which is incorporated herein by reference.

BACKGROUND OF THE INVENTION

1. Field of the Invention

The present invention relates generally to a force-resisting structure or support and, more particularly, to a force-resisting structure or support foldably constructed from one or more foldable blanks and especially suited for use as a pallet or dunnage support.

2. Brief Discussion of the Related Art

A pallet is primarily used to accommodate the mechanized bulk handling and transport of products. Typically, a pallet comprises a flat, elevated top surface for supporting a load, such as goods, containers, or packages, a sufficient distance above the ground or floor so that the fork of a forklift can be inserted under the top surface in order to move the pallet with the entire load thereon from place to place. Traditionally, most pallets have been made from pieces of wood, specifically soft wood, assembled with metal fasteners such as nails or screws. However, a number of problems face present day users of conventional wooden pallets. The rising cost of making and repairing wooden pallets has detracted from the overall cost effectiveness of palletized shipments. Wooden pallets are heavy, bulky and cumbersome, and empty wooden pallets require substantial storage space. It is especially costly to transport empty wooden pallets by rail or truck for reuse.

To save costs, conventional wooden pallets purchased and used by shippers are ordinarily returned to the shipper for reuse, but since wooden pallets are heavy, bulky and cumbersome, they are inconvenient to store and relatively expensive to return to the shipper. If the wooden pallet is not reused, it must be disposed of in a proper manner. Generally speaking, landfill or other waste disposal sites will not accept wooden pallets as is; rather, the pallets must first be reduced either by chipping or burning prior to disposal. Chipping adds significant cost to wooden pallet disposal, and burning wooden pallets is often precluded by environmental regulations.

In some instances, used wooden pallets can be retrieved by pallet recyclers. Recyclers who retrieve unwanted wooden pallets usually accept only certain sizes of wooden pallets and, most commonly, charge a fee for their retrieval. After repair or refurbishment, the recycler may attempt to resell the used wooden pallets. The market for recycled wooden pallets is limited, however, because many retailers refuse to receive goods transported on recycled wooden pallets due to the lack of any standards regulating the quality of the repair or refurbishment of used wooden pallets. Products shipped internationally on even new wooden pallets are faced with increasing regulations requiring various forms of chemical treatment to the wood to prevent infestation and transport of insects and parasites. Pallets constructed of plastic or metal have been proposed, but plastic and metal pallets have many of the same disadvantages as wooden pallets including being heavy, bulky and cumbersome, being costly and inconvenient to transport, store and dispose of, and being incompatible with environmental preservation. In view of the various drawbacks to pallets made from wood, plastic or metal, it would be desirable to construct a pallet from a material other than wood, plastic or metal, while maintaining many of the desirable characteristics generally associated with pallets made from wood, plastic and metal to provide a pallet that is lighter in weight, less expensive, strong, of simplified construction, easier and less costly to transport and store, that requires less space for storage, that is more readily recyclable or disposable, and that minimizes environmental impact.

A pallet constructed from a readily recyclable material such as corrugated paperboard would be especially desirable. In warehouses and retail stores, separate receptacles are commonly provided for collecting, compacting and/or storing recyclable materials, such as paperboard and plastics. The recyclable materials can then be retrieved, and oftentimes sold, and recycled into new materials and/or products. Corrugated paperboard, which is particularly conducive to being recycled, is typically formed as a layered structure or composite comprising a corrugated medium sandwiched between liner sheets. The corrugated medium forms a series of interconnected arches providing substantial structural strength. For example, a sheet of corrugated paperboard held in a vertical position can support a weight many times greater than its own weight.

Pallets made of corrugated paperboard have been proposed including pallets constructed from foldable corrugated paperboard blanks as represented by U.S. Pat. No. 6,029,582 to Ogilvie, Jr. et al. In many conventional corrugated paperboard pallets, the vertical supports for the elevated top surface of the pallet are secured with extraneous fasteners, including adhesive fasteners such as glue or mechanical fasteners such as staples or clips, and are not secured by the paperboard blanks themselves. Since an individual pallet ordinarily includes a plurality of vertical supports, the need to apply an extraneous fastener to each vertical support adds to the cost, time, labor and complexity involved in constructing or assembling the pallet. Furthermore, paperboard pallets in which the vertical supports are secured with extraneous fasteners are usually lacking in torsional strength. The extraneous fasteners also introduce undesirable materials into the pallet, and the fasteners may limit or complicate recyclability of the pallet. Some paperboard pallets rely on frictional securement of a top member of the pallet, which defines the elevated top surface, to a bottom member of the pallet, and such frictional securements lend little or no torsional support or strength to the overall pallet structure. Many conventional paperboard pallets do not have full perimeter support for the elevated top surface. Consequently, the force from a load carried on the elevated top surface can cause the elevated top surface to deflect in areas where the load is not directly supported by vertical supports of the pallet. Some conventional paperboard pallets cannot be foldably constructed or assembled from a single paperboard blank but, rather, require at least two foldable paperboard blanks that are assembled and then fastened together with extraneous fasteners. Some paperboard pallets attempt to duplicate the design of conventional wooden pallets, and these pallets are usually both heavy and expensive despite being made of paperboard.

Solid paperboard sheets known as slip-sheets are sometimes interposed between a load and a horizontal surface, such as the ground or floor, on which the load is supported. The slip-sheet is typically larger in peripheral size than the footprint of the load thereon thusly presenting an exposed marginal edge of the slip-sheet that can be grasped to slide the slip-sheet with the load thereon along the horizontal surface. Slip-sheets are not structurally or functionally similar to pallets.

A dunnage support is a type of packing conventionally utilized in transporting products. Conventional dunnage supports are ordinarily made of a foam material, and similar problems that arise with respect to the disposal of wooden, plastic and metal pallets also arise after the useful life of a dunnage support has ended. Additionally, the foam material of a conventional dunnage support can be prone to crumbling after a high impact, a characteristic that can lead to damage to both the dunnage support and the product being transported. The lack of a recycling program for foam both adds to the cost of dunnage supports and has caused various industries that utilize dunnage supports to look for dunnage supports that can be made of an alternate material to foam while still maintaining the positive characteristics associated with foam materials.

The need exists, therefore, for improved foldably constructed force-resisting structures or supports constructed from one or more foldable blanks, preferably corrugated paperboard blanks, and especially suited for use as a pallet or as a dunnage support.

SUMMARY OF THE INVENTION

A foldably constructed force-resisting structure comprises a top member and a bottom member each formed as a one-piece blank of sheet material or formed together as a one-piece blank of sheet material initially in a flat or planar condition prior to being foldably constructed or assembled into the force-resisting structure. The sheet material is preferably corrugated paperboard. The top member comprises a top member base panel having a perimeter defined by a plurality of side edges, and the bottom member comprises a bottom member base panel having a perimeter defined by a plurality of side edges in correspondence with the side edges of the top member base panel. The top member further includes at least one side portion foldably connected to a side edge of the top member base panel by a side portion fold line. The top member side portion is folded downwardly from the top member base panel along the side portion fold line to a position at least substantially perpendicular to the top member base panel. The top member side portion may include a continuous side wall foldably connected to the top member base panel at the side portion fold line and extending the entire or substantially the entire length of the side edge of the top member base panel. The top member side portion may comprise a plurality of side wall segments foldably connected to the side edge of the top member base panel at respective side portion fold lines. The side wall segments can be separated from one another by spaces along the side edge of the top member base panel. The top member side portion may comprise a retention element foldably connected to the side edge of the top member base panel at a retention element fold line.

The bottom member includes at least one side portion foldably connected to a side edge of the bottom member base panel at a side portion fold line. The bottom member side portion is folded upwardly from the bottom member base panel along the side portion fold line to a position at least substantially perpendicular to the bottom member base panel. The bottom member side portion may comprise a continuous side wall, a plurality of side wall segments separated by spaces and/or a retention element as in the case of the top member side portion.

The top and bottom members are assembled and secured in nested relation with the base panels being at least substantially parallel to one another, the top member base panel defining an elevated surface for supporting a load thereon. The top and bottom members may be secured by interlocking engagement of portions of the blanks themselves. Alternatively, or in addition, the top and bottom members can be secured using extraneous fasteners including adhesive and/or mechanical fasteners. The top and bottom member side portions may be disposed in overlapping relation when the top and bottom members are in nested relation, and the overlapping top and bottom member side portions can be secured to one another.

When the top and bottom members are in nested relation, a peripheral side of the force-resisting structure extends along the perimeters of the base panels and is defined at least in part by the side portions of the top and bottom members. An interior of the force-resisting structure is defined between the top and bottom member base panels and is circumscribed by the peripheral side. At least one access opening in the peripheral side of the force-resisting structure provides communication with the interior for insertion of a lifting mechanism allowing the force-resisting structure, with a load supported on the top member base panel, to be lifted and moved from place to place.

The force-resisting structure comprises a vertical support rib structure within the interior having an X-shaped or cross-shaped configuration and formed from the top member base panel and/or the bottom member base panel so that the support rib structure is formed from the initial blank or blanks. In one embodiment, the perimeter of the top member base panel has two pairs of diagonally opposed corners, and a vertical support rib is formed from the top member base panel to extend diagonally between one pair of the diagonally opposed corners. The bottom member base panel has four corners in correspondence with the corners of the top member base panel, and a support rib is formed from the bottom member base panel to extend diagonally between the other pair of diagonally opposed corners. The support ribs of the top and bottom members interlock with one another when the top and bottom members are assembled in nested relation and form an X-shaped support rib structure within the interior of the force-resisting structure. In another embodiment of the force-resisting structure, an X-shaped support rib structure is foldably constructed from a plurality of support ribs formed from the bottom member base panel, in which case the top member can be provided without a support rib. In a further embodiment, the support ribs are foldably constructed into a cross-shaped support rib structure in which the support ribs extend perpendicular to one another. The support ribs forming the cross-shaped support rib structure may be constructed from support ribs formed from the bottom member base panel but could alternatively be cooperatively constructed from top and bottom member support ribs. The support ribs of the cross-shaped rib structure may extend perpendicular to opposed side edges of the bottom member base panel.

The support ribs for the force-resisting structures comprise a pair of rib panels having inner side edges foldably interconnected to one another along a crest fold line of the base panel and outer side edges foldably interconnected to the base panel along respective base fold lines. The rib panels are folded from the base panel, i.e. downwardly in the case of the top member base panel and upwardly in the case of the bottom member base panel, to an extended position in which the rib panels are disposed in overlapping relation and at least substantially perpendicular to the base panel. In addition, when the rib panels are folded to the extended position, the outer side edges of the rib panels are brought adjacent to one another. The support rib may include a locking assembly for locking the support rib in its extended position. However, it should be appreciated that extraneous fasteners including adhesive and/or mechanical fasteners could be used to secure the support ribs in their extended position.

The locking assembly for a support rib includes a window and a pass-through aperture formed in a first rib panel, at least one gate flap in the other rib panel, a locking formation on the gate flap, and a corresponding locking formation on the other rib panel cooperatively engageable with the locking formation on the gate flap. When the support rib is in the extended position, the gate flap is reverse folded through the window, and the locking formation on the gate flap is inserted through the aperture and is cooperatively engaged with the corresponding locking formation on the other rib panel.

Various objects, features and advantages of the present invention will become apparent from the following description of the preferred embodiments taken in conjunction with the accompanying drawings wherein like reference numerals refer to like or similar parts.

DESCRIPTION OF THE PREFERRED EMBODIMENTS

Figure 1:
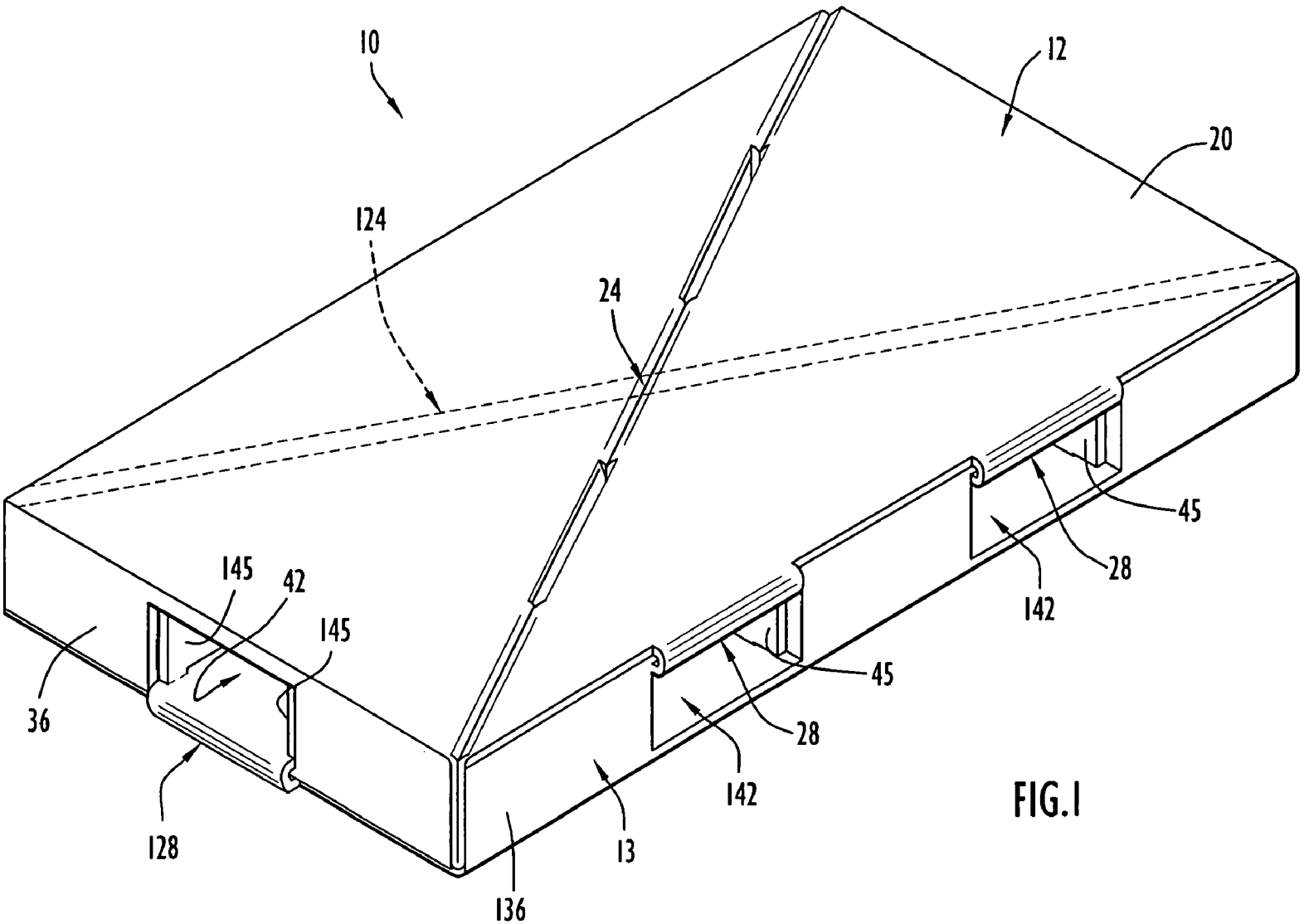
FIG. 1 is a perspective view of a foldably constructed force-resisting structure according to the present invention.
Figure 2:
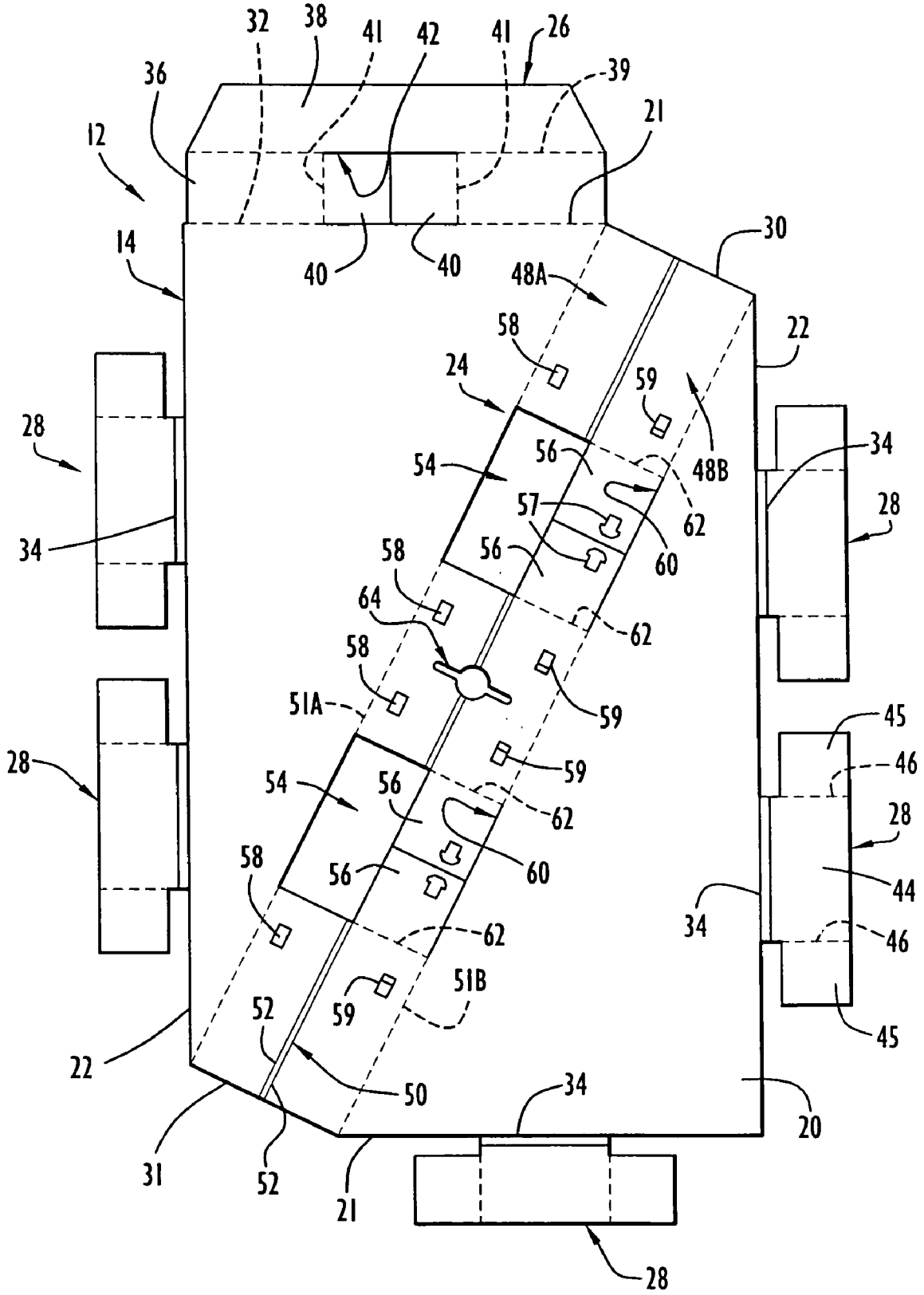
FIG. 2 is a plan view of a first or top member of the foldably constructed force-resisting structure of FIG. 1 prior to being foldably constructed.
Figure 3:
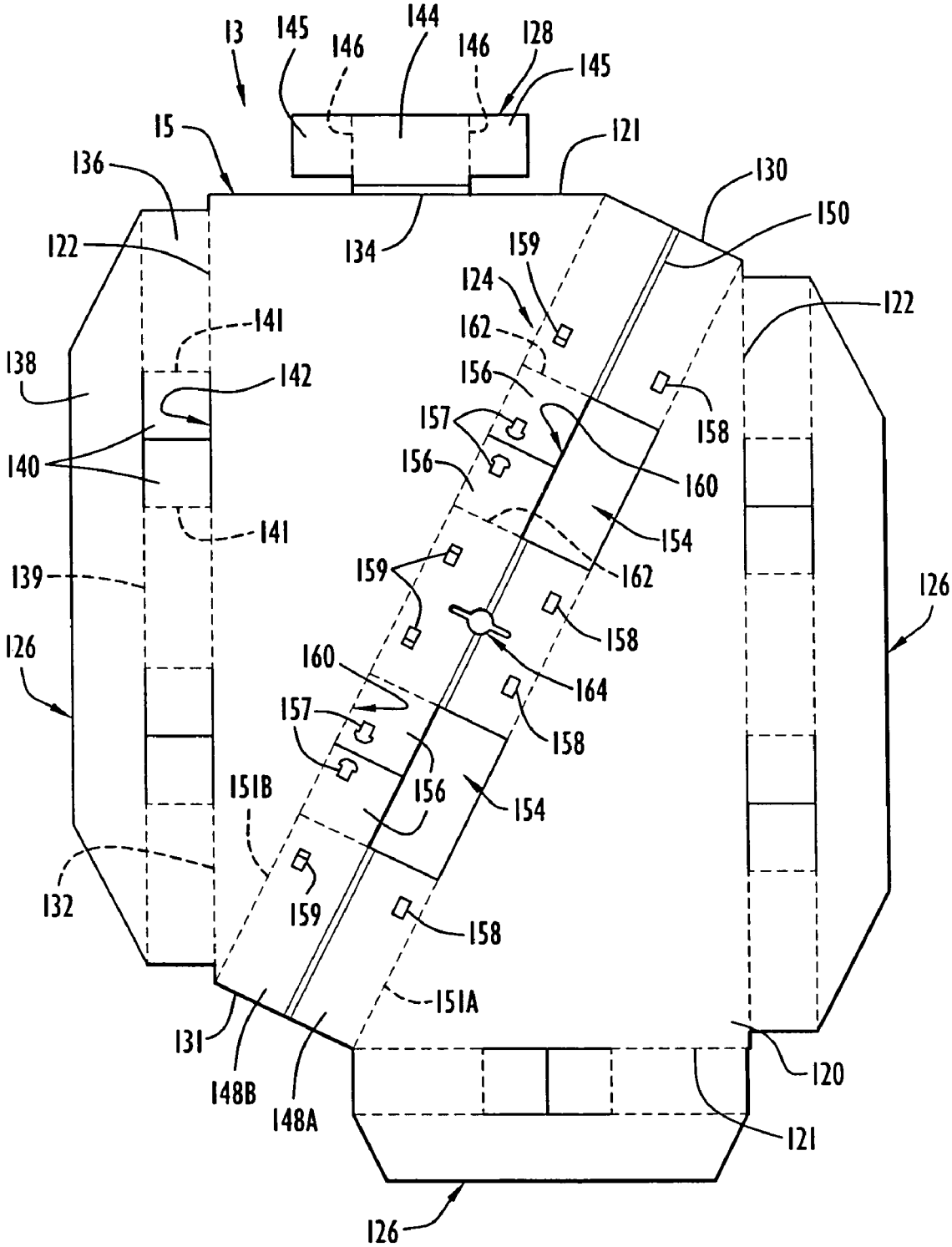
FIG. 3 is a plan view of a second or bottom member of the foldably constructed force-resisting structure of FIG. 1 prior to being foldably constructed and assembled to the top member.

A foldably constructed or assembled force-resisting structure or support 10 according to the present invention is illustrated in FIG. 1. The force-resisting structure 10 comprises a first or top member 12 and a second or bottom member 13 assembled to the top member 12. Prior to being foldably constructed or assembled, the top member 12 is in an unfolded condition comprising a first or top member blank 14 as depicted in FIG. 2. Prior to being foldably constructed or assembled, the bottom member 13 is in an unfolded condition comprising a second or bottom member blank 15 as depicted in FIG. 3. The blanks 14 and 15 are each flat or planar in the unfolded condition, each blank 14 and 15 being formed integrally and unitarily or monolithically as a single piece of sheet material. Preferably, the sheet material from which blanks 14 and 15 are made is paperboard and, most preferably, corrugated paperboard. However, thermal plastics or ductile metals could be used for the sheet material. The blanks 14 and 15 can each be cut in any suitable manner from the sheet material, such as by die or stamp cutting. The blanks 14 and 15 can be treated in various ways to make them suitably moisture and water resistant. The blanks 14 and 15 can be made from virgin materials or from recycled materials. The blanks 14 and 15 can be manufactured at the site of construction and/or use of the force-resisting structure 10. The blanks 14 and 15 made of paperboard sheet material are easily and routinely recyclable while maintaining many of the desirable characteristics of less readily recyclable materials such as wood, metal and various plastics.

Figure 4:
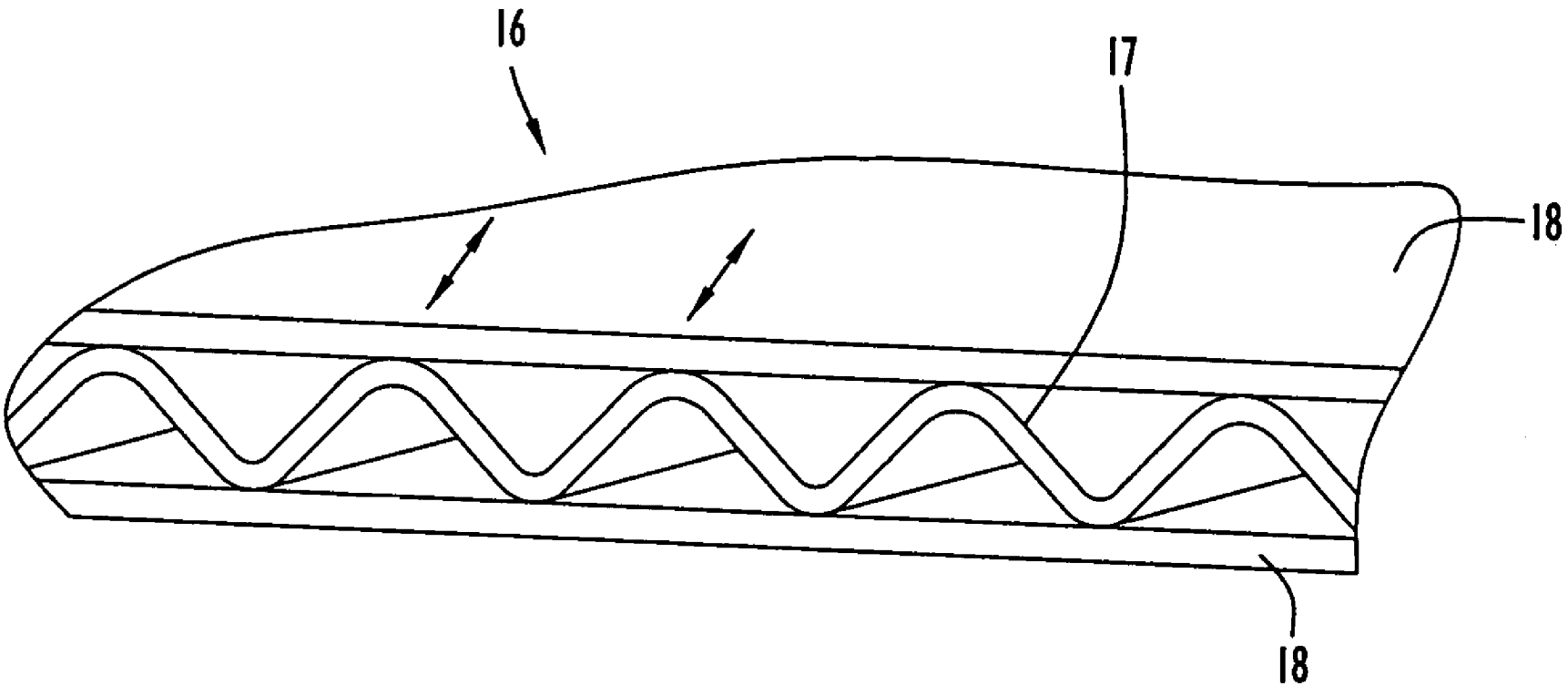
FIG. 4 is a broken perspective view depicting a preferred sheet material for the top and bottom members.

FIG. 4 illustrates a corrugated paperboard 16 from which blanks 14 and 15 are preferably made. Corrugated paperboard 16 comprises a corrugated medium 17 held or sandwiched between liner sheets 18. The corrugated medium 17, which is typically made from a short fiber paper, is configured with flutes or pleats forming interconnected arches. The flutes or pleats extend lengthwise along parallel lines of corrugation as shown by arrows in FIG. 4. The arches are typically glued to the liner sheets 18, which are normally made of puncture resistant paper. Corrugated paperboard used for blanks 14 and 15 can be manufactured in various ways. Corrugated paperboard used for blanks 14 and 15 can be treated in various ways including chemical cooking processes, surface treatment including but not limited to flame treatment, and/or coating processes.

As explained further below, each blank 14 and 15 has foldable portions foldable along fold or crease lines defined or formed in the blanks in order to foldably construct or assemble the top and bottom members 12 and 13. Each blank 14 and 15 is provided, where necessary, with cut lines creating separable edges in the blanks for various purposes including to define or form the foldable portions and/or other structural elements, and/or to allow for or facilitate folding of the foldable portions. The cut lines can be formed as complete cuts extending entirely through the thickness of the sheet material to form completely severed separable edges. Alternatively, the cut lines can be formed as partial cuts, such as perforations or score lines, extending partly through the thickness of the sheet material to form partly severed separable edges that can be severed completely during foldable construction or assembly. Either or both blanks 14 and 15 may have one or more cut-out windows of various shapes and sizes where the sheet material is completely removed or is completely removed during foldable construction or assembly to serve various purposes. Some of the purposes that may be served by the provision of cut-out windows include simplifying the manufacture or preparation of the blanks, facilitating foldable construction or assembly of the force-resisting structure, allowing for interlocking engagement between portions of the same or different blanks, and reducing weight when possible without sacrificing necessary structural strength. The peripheral dimensions and thickness of the blanks 14 and 15 and the location of the fold lines, cut lines and cut-out windows can vary in accordance with the features desired for the force-resisting structure 10 based on its intended application.

Top member 12 and its blank 14, as best shown in FIG. 2, comprises a top member base panel 20 demarcated or circumscribed by a plurality of side edges including opposed first side edges 21 and opposed second side edges 22. The top member 12 includes an interior vertical support rib 24 foldable from base panel 20 as described further below. The top member 12 further comprises at least one side portion 26 foldably connected to the base panel 20 along a side edge thereof and/or at least one locking or retention element 28 foldably connected to the base panel 20 along a side edge thereof.

The base panel 20 can have various peripheral configurations and/or sizes upon folding of support rib 24 as demarcated or circumscribed by first side edges 21 and second side edges 22 in accordance with the dimensions desired for the force-resisting structure 10. In the case of force-resisting structure 10, the base panel 20 has a four-sided peripheral configuration with four corners upon folding of support rib 24 and, in particular, a rectangular peripheral configuration. Accordingly, the first side edges 21 are parallel to one another, and the second side edges 22 are parallel to one another and perpendicular to the first side edges 21. Prior to folding of the support rib 24, the perimeter of base panel 20 is further demarcated or circumscribed by a first canted side edge 30 connecting the end of one first side edge 21 to the end of one second side edge 22, and a second canted side edge 31 connecting the opposite end of the other first side edge 21 to the opposite end of the other second side edge 22. The canted side edges 30 and 31 are parallel. When the support rib 24 is folded from the base panel 20 to an extended position as explained further below, the canted side edges 30 and 31 are perpendicular or substantially perpendicular to the plane of base panel 20, and the ends of side edges 21 will meet or come adjacent the ends of side edges 22 such that two pairs of diagonally opposed corners will be defined by the perimeter of the base panel 20.

The top member 12 is depicted with a side portion 26 foldably connected to the base panel 20 along a first side edge 21 for securement to the bottom member 13 when the top and bottom members are assembled in nested relation. The side portion 26 is formed in blank 14 as an extension to the base panel 20, and the first side edge 21 along which the side portion 26 is foldably connected to the base panel 20 comprises a side portion fold or crease line 32 in blank 14. The fold line 32 preferably extends the entire or substantially the entire length of first side edge 21 between canted side edge 30 and side edge 22. It should be appreciated that a side portion 26 can be provided along either or both first side edges 21 and/or along either or both second side edges 22.

The top member 12 is depicted with opposed retention elements 28, there being at least one retention element 28 foldably connected to the base panel 20 along each second side edge 22. In particular, the top member 12 is shown with two retention elements 28 foldably connected to the base panel 20 along each second side edge 22. In addition, the top member 12 is depicted with a single retention element 28 foldably connected to the base panel 20 along the first side edge 21 that is opposite the first side edge 21 that is foldably connected to side portion 26. Each retention element 28 is formed in blank 14 as an extension to the base panel 20 and is foldably connected to the base panel 20 at a retention element fold or crease line 34 defined in blank 14 along the corresponding side edge of base panel 20. It should be appreciated that the top member 12 can have one or more retention elements 28 along either or both second side edges 22 and/or along either or both first side edges 21. In the case of force-resisting structure 10, each second side edge 22 has its retention elements 28 located directly opposite the retention elements 28 on the opposite second side edge 22. It should be appreciated, however, that one side edge can have one or more retention elements 28 situated at different opposed locations from one or more retention elements 28 on the opposite side edge such that the opposed retention elements do not have to be exactly or directly opposite one another. As explained further below, each retention element 28 of the top member 12 interlocks with a corresponding access opening in a side wall of the bottom member 13 when the top and bottom members are foldably constructed and assembled to one another.

The side portion 26 comprises a side wall 36 and a tuck flap 38. The side wall 36 is foldably connected to the base panel 20 at the corresponding side portion fold or crease line 32, which may be considered a side wall fold or crease line and, more particularly, an inner side wall fold or crease line. The tuck flap 38 is foldably connected to the side wall 36 at a tuck flap or outer side wall fold or crease line 39 defined in blank 14. The tuck flap fold line 39 is parallel to the fold line 32, and an outer side edge of the tuck flap 38 is parallel to the fold lines 39 and 32. Preferably, the tuck flap fold line 39 extends the majority of the length of fold line 32, the tuck flap fold line 39 being depicted as being the same or substantially the same length as the fold line 32. The outer side edge of the tuck flap 38 is preferably shorter in length than the tuck flap fold line 39, with the tuck flap having beveled end edges extending angularly inwardly from the ends of the tuck flap fold line 39 to the outer side edge of the tuck flap.

At least one side wall flap 40 is provided in the side wall 36 for folding relative to the side wall along a side wall flap fold or crease line 41 to present, reveal or expose an access opening 42 in the side wall as explained further below. Preferably, a pair of side wall flaps 40 are provided in the side wall 36 and cooperate to expose an access opening 42 in the side wall. As described further below, the access opening 42 in the top member 12 interlocks with a corresponding retention element of the bottom member 13 when the top and bottom members are foldabely constructed and assembled to one another in nested relation.

Each side wall flap 40 has an inner side edge adjacent, close to or along the fold line 32 and an outer side edge adjacent, close to or along the fold line 39. The fold line 41 for each side wall flap 40 extends perpendicularly between the inner and outer side edges of the side wall flap. Each side wall flap 40 is foldably connected to the side wall 36 along the fold line 41 and is formed or defined in blank 14 by a cut line, which also forms the access opening 42. Where the access opening 42 is exposed in its entirety by folding of a single side wall flap 40 relative to the side wall 36, the side wall flap 40 preferably is about the same size as the access opening 42, and the access opening is circumscribed by the fold line 41 and by the edges which result from cutting the blank 14 to form the side wall flap. Where the access opening 42 is exposed by folding two side wall flaps 40 relative to the corresponding side wall 36, as depicted for top member 12, the two side wall flaps 40 together are preferably about the same size as the access opening 42, and the access opening is circumscribed by the fold lines 41 of both side wall flaps 40 and by the edges which result from cutting blank 14 to form the side wall flaps. In the top member 12, each side wall flap 40 is about one half the size of the access opening 42, and the side wall flaps 40 are foldable along their fold lines 41 in outward opposition to one another to expose the access opening.

Each retention element 28 comprises a retention flap 44 and at least one wing 45 foldably connected to one end of the retention flap. The retention flap 44 has an inner side edge foldably connected to base panel 20 along the corresponding retention element fold line 34. The wing 45 is foldably connected to the retention flap 44 at a wing fold or crease line 46 extending perpendicular to the fold line 34. The wing fold line 46 extends from an end of the fold line 34 to an outer side edge of the retention element 28 that is parallel to the corresponding side edge 21 or 22 and to the fold line 34. The outer side edge of the retention element 28 defines an outer side edge of the retention flap 44, parallel to the inner side edge of the retention flap, and defines an outer side edge of the wing 45. The outer side edge of the wing 45 extends laterally from the fold line 46, and the wing 45 has an inner side edge that extends laterally from the fold line 46 in parallel with the corresponding side edge 21 or 22 and the outer side edge of the wing but close to the fold line 34. The wing 45 also has an end edge extending perpendicularly between its outer and inner side edges in parallel with the fold line 46. The fold line 34 for each retention element 28 may comprise separate parallel folds or creases formed in blank 14 and separated or spaced from one another by a desired distance.

The top member 12 is depicted with each retention element 28 comprising more than one wing 45. In particular, each retention element 28 of top member 12 is depicted as comprising two wings 45 extending laterally in opposite directions from the opposite ends of the retention flap 44, with each wing 45 being foldably connected to the retention flap 44 along a wing fold line 46. The wings 45 of each retention element 28 are essentially mirror images of one another with their fold lines 46 being parallel.

The interior vertical support rib 24 for top member 12 comprises a pair of foldably interconnected rib panels 48A and 48B that extend diagonally from one canted side edge 30 to the other canted side edge 31 of the top member base panel 20. The rib panels 48A and 48B, which are formed from blank 14, are foldably interconnected to each other at their inner side edges along a crest fold line or crease 50 formed or defined in blank 14. The rib panels 48A and 48B have respective outer side edges foldably connected to the base panel 20 along respective base fold lines or creases 51A and 51B formed or defined in blank 14. The canted side edges 30 and 31 define end edges of the rib panels 48A and 48B and of the support rib 24 formed therefrom. The crest fold line 50 centrally bisects the support rib 24 and terminates at the mid points of the canted side edges 30 and 31. The crest fold line 50 is perpendicular to the canted side edges 30 and 31, and the center of the crest fold line is midway between the canted side edges. The crest fold line 50 may be composed of separate parallel fold lines or creases 52 formed in blank 14 and separated from one another by a suitable separation distance to facilitate folding of the support rib 24.

The base fold lines 51A and 51B are parallel to one another and to the crest fold line 50. The base fold lines 51A and 51B terminate at the end points of the canted side edges 30 and 31 and are the same length as the crest fold line 50. The base fold lines 51A and 51B define a 45° or substantially a 45° angle with the side edges 21 and 22. The support rib 24, which is initially coplanar or substantially coplanar with base panel 20 in the unfolded condition for blank 14, is foldable from base panel 20 to an extended or vertical position by folding the rib panels 41A and 41B along the crest fold line 50 and base fold lines 51A and 51B to a position perpendicular or substantially perpendicular to base panel 20 as explained further below. In the extended position, the rib panels 41A and 41B are parallel or substantially parallel to one another in overlapping relation, and the base fold lines 51A and 51B will be adjacent, close to or in abutment with one another. Consequently, the side edges 21 will meet the side edges 22 at four right angle or substantially right angle corners, and the support rib 24 will extend diagonally from one corner of the base panel 20 to the opposite diagonally located corner.

The support rib 24 comprises a locking assembly for locking the support rib 24 in the extended or vertical position. However, it should be appreciated that extraneous fasteners including adhesive fasteners such as tape or glue and mechanical fasteners such as staples or clips could be used to secure the support rib 24 in the extended position alternatively or in addition to the locking assembly. The locking assembly comprises a window or pass-through opening 54 in a first rib panel 48A or 48B, at least one gate flap 56 in the second rib panel 48A or 48B for being folded through the window 54, a locking formation 57 on the gate flap, a pass-through aperture 58 in the first rib panel for passage of the locking formation 57 therethrough, and a locking formation 59 on the second rib panel for locking engagement with the locking formation 57 passed through aperture 58.

The window or pass-through opening 54 is illustrated as being formed in the rib panel 48A, which is depicted as having two windows 54 formed therein each associated with at least one gate flap 56. The windows 54 are formed in the rib panel 48A by cutting the blank 14 to completely remove or to allow complete removal of the sheet material within the perimeter of the window. Each window 54 has its perimeter circumscribed by an outer side edge extending adjacent, along or coincident with the base fold line 51A, opposed end edges extending from the outer side edge of the window toward crest fold line 50, and an inner side edge defined at least in part by the inner side edge of the associated gate flap 56 prior to the gate flap being folded. The inner and outer side edges of the window 54 are parallel, and the end edges of the window are perpendicular to its inner and outer side edges. The windows 54 are illustrated as being equally spaced in opposite directions from the center of the crest fold line 50.

The gate flap 56 is foldably connected to the rib panel 48B along a gate flap fold line 62 perpendicular to crest fold line 50 and base fold lines 51A and 51B. The gate flap 56 is in alignment with the window 54 and is foldable outwardly from the plane of rib panel 48B along the gate flap fold line 62, allowing the gate flap 56 to be folded through the aligned window 54 when the support rib 24 is in the extended or vertical position. When the gate flap 56 is folded outwardly from the rib panel 48B and through the window 54, a gate flap opening 60 is exposed in rib panel 48B in alignment with the window 54. The rib panel 48B is depicted with two gate flap openings 60 respectively aligned with the windows 54, each gate flap opening 60 being associated with two gate flaps 56 foldably connected to the rib panel 48B along respective gate flap fold lines 62. Each gate flap 56 has an inner side edge which, when the gate flap is in an unfolded condition co-planar or substantially co-planar with rib panel 48B, defines at least part of the inner side edge of the corresponding window 54. In the support rib 24, the two gate flaps 56 for each window 54 are together slightly smaller than the peripheral size of the window 54 to allow the gate flaps 56 to be folded through the window 54. In the support rib 24, each gate flap 56 is slightly smaller than about one half the peripheral size of the corresponding window 54. Therefore, when the gate flaps 56 are in the unfolded condition, the inner side edges of the two gate flaps 56 corresponding to a window 54 define or complete the inner side edge of the window 54. Consequently, upon folding of the gate flaps 56 outwardly from the rib panel 48B and through the corresponding window 54, the exposed gate flap opening 60 is continuous or in unison with the window 54 aligned therewith. The inner side edges of the gate flaps 56 and, therefore, the inner side edges of windows 54, may extend adjacent, along or coincident with the crest fold line 50. The gate flaps 56 have outer side edges that extend adjacent, along or coincident with the base fold line 51B in parallel with the inner side edges of the gate flaps. The gate flap fold lines 62 extend perpendicular to the inner and outer side edges of the gate flaps 56 and are also perpendicular to the crest fold line 50 and the base fold lines 51A and 51B. The gate flap fold lines 62 are coincident with the end edges of the corresponding window perimeter. Each gate flap 56 has an end edge opposite and in parallel with its gate flap fold line 62. When the two gate flaps 56 for a corresponding window 54 are in the unfolded condition, the end edges of the gate flaps are preferably disposed adjacent, close to or in abutment with one another.

When the rib panels 48A and 48B are folded to the extended position, the gate flaps 56 for each window 54 can be folded along their gate flap fold lines 62 about 180° and through the corresponding window 54 to a reverse folded position where the gate flaps 56 are in overlapping relation with the opposite face of rib panel 48A. Folding the gate flaps 56 to the reverse folded position involves folding the gate flaps 56 of each pair in outward opposition to one another from rib panel 48B. In the reverse folded position, the gate flaps 56 wrap around the end edges of the window 54, and the rib panel 48A is confined between the gate flaps 56 and the rib panel 48B. The rib panels 48A and 48B and the gate flap 56 will be parallel or substantially parallel to one another. In addition, the rib panels 48A and 48B and the gate flaps 56 will all extend perpendicular or substantially perpendicular to the base panel 20, and the windows 54 will be aligned with the corresponding gate flap openings 60. The gate flaps 56 can be formed by appropriate cut lines in blank 14 which also form the gate flap openings 60.

The locking formations 57 on the gate flaps 56 can be designed in various ways and may be configured as locking tabs or enlargements. The pass-through apertures 58 in the rib panel 48A that correspond to the locking formations 57 can have various configurations to allow the locking formations 57 to be inserted therethrough. The locking formations 57 are situated on the gate flaps 56, and the corresponding pass-through apertures 58 are situated on the rib panel 48A, such that the locking formations 57 align or can be folded into alignment with the apertures 58 when the gate flaps 56 are folded through the window 54 to the reverse folded position. The locking formations 59 on rib panel 48B can be configured in various ways to lockingly engage with the locking formations 57 passed through the apertures 58. As an example, the locking formations 59 can be configured as receptors for the locking formations 57. The locking formations 59 are situated on the rib panel 48B to allow the corresponding locking formations 57 that have been passed through apertures 58 to engage with the corresponding locking formations 59.

The foldably constructed force-resisting structure 10 further comprises a connector for connecting the support rib 24 of top member 12 to a corresponding support rib of bottom member 13 when the top and bottom members are assembled to one another in nested relation as explained further below. In the force-resisting structure 10, the connector is formed by a rib slot 64 in support rib 24 and a similar rib slot 164 in the support rib of bottom member 13 that interlocks with the rib slot 64. The rib slot 64 depicted for support rib 24 comprises a circular central rib slot portion bisected by crest fold line 50 and two elongated diametric rib slot portions extending diametrically in opposite directions from the central rib slot portion in a direction perpendicular to the crest fold line 50. The central rib slot portion is formed partly in rib panel 48A and partly in rib panel 48B. One diametric rib slot portion is formed in rib panel 48A and the other is formed in rib panel 48B. The central rib slot portion has its center aligned with the center or midpoint of crest fold line 50 between canted side edges 30 and 31. The connector for the support ribs of the top and bottom members can be designed in various ways, including as a single rib slot of appropriate configuration in either the top or bottom support rib.

Bottom member 13 and its blank 15, as best shown in FIG. 3, comprises a bottom member base panel 120 demarcated or circumscribed by a plurality of side edges including first side edges 121 in correspondence with the first side edges 21 of the top member base panel 20 and second side edges 122 in correspondence with the second side edges 22 of the top member base panel 20. The bottom member 13 includes an interior vertical support rib 124 foldable from base panel 120 as described further below. The bottom member 13 further comprises at least one side portion 126 foldably connected to the base panel 120 along a side edge thereof to provide an access opening in the bottom member 13 to interlock with a retention element 28 of the top member 12 and/or the bottom member comprises at least one retention element 128 foldably connected to the base panel 120 along a side edge thereof to interlock with an access opening 42 in top member 12. The base panel 120 is similar to the base panel 20 and can have various peripheral configurations and/or sizes in accordance with the dimensions of the top member base panel 20. Prior to the support rib 124 being folded to the extended position, the perimeter of base panel 120 includes canted side edges 130 and 131 as explained above for base panel 20.

Bottom member 13 is depicted with side portions 126 located along one side edge 121 and both side edges 122 of base panel 120 in correspondence with the side edges of base panel 20 associated with retention elements 28. Each side portion 126 is similar to side portion 26 and comprises a side wall 136 foldably connected to the side edge of the base panel 120 at a side portion fold line 132, which may also be considered a side wall fold line or an inner side wall fold line, a tuck flap 138 foldably connected to the side wall 136 at a tuck flap or outer side wall fold line 139, an access opening 142 in the side wall 136 located in correspondence with a retention element 28 of the top member 12, and a pair of side wall flaps 140 foldably connected to the side wall 136 at side wall flap fold lines 141.

The bottom member 13 is illustrated with a single retention element 128 located along the side edge 121 of base panel 120 that corresponds to the side edge of base panel 20 associated with a side portion 26. The retention element 128 is similar to retention element 28 and comprises a retention flap 144 foldably connected to the side edge of base panel 120 along a retention flap fold or crease line 134, and two wings 145 foldably connected to the retention flap along wing fold lines 146.

The support rib 124 of bottom member 13 is similar to support rib 24 and comprises rib panels 148A and 148B formed from base panel 120. The rib panels 148A and 148B have inner side edges foldably interconnected at crest fold line 150 and outer side edges foldably connected to base panel 120 at respective base fold lines 151A and 151B. The support rib 124 is foldable to an extended position by folding rib panels 148A and 148B along crest fold line 150 and base fold lines 151A and 151B as described above for support rib 24, and the support rib 124 has a locking assembly for locking the support rib 124 in the extended position. The locking assembly for support rib 124 is similar to that described above for support rib 24 and includes a window or pass-through opening 154 in first rib panel 148A or 148B, a gate flap 156 in a second rib panel 148A or 148B for being reverse folded through the window when the support rib is in the extended position, a locking formation 157 on the gate flap, a corresponding pass-through opening 158 on the first rib panel for passage or extension of the locking formation 157 therethrough, and a locking formation 159 on the second rib panel for locking engagement with the locking formation 157 passed through aperture 158. A gate flap opening 160 is exposed to the second rib panel when the gate flaps 156 are reverse folded along gate flap fold line 162 through the corresponding window 154, and the gate flap opening 160 is aligned with the corresponding window 154. In the bottom member 13, the windows 154 and pass-through apertures 158 are provided in the rib panel 148A, while the gate flaps 156, the locking formation 159 and the gate flap openings 160 are provided in rib panel 148B. The support rib 124 also comprises a rib slot 164 similar to the rib slot 64 (see FIG. 2).

Figure 5:
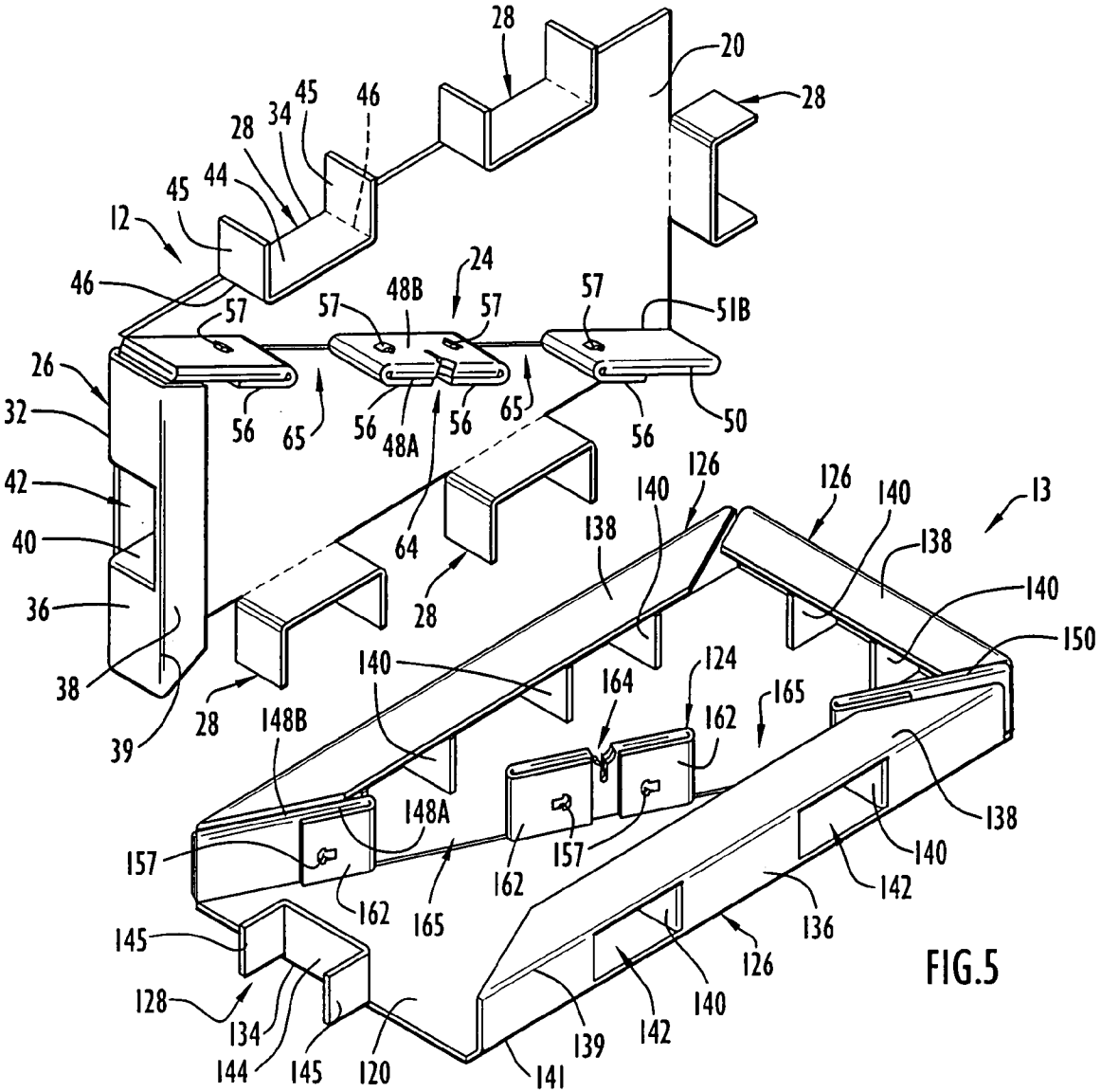
FIG. 5 is a perspective view of the top and bottom members in a partially foldably constructed condition showing interior vertical support ribs of the top and bottom members folded relative to respective base panels of the top and bottom members, showing side portions of the top and bottom members folded relative to the respective base panels, showing side wall flaps of the side portions folded relative to respective side walls of the side portions to expose access openings in the side walls, showing tuck flaps of the side portions folded relative to the respective side walls, and showing initial folding of retention elements of the top and bottom members in which wings of each retention element are folded relative to a retention flap of the retention element.
Figure 6:
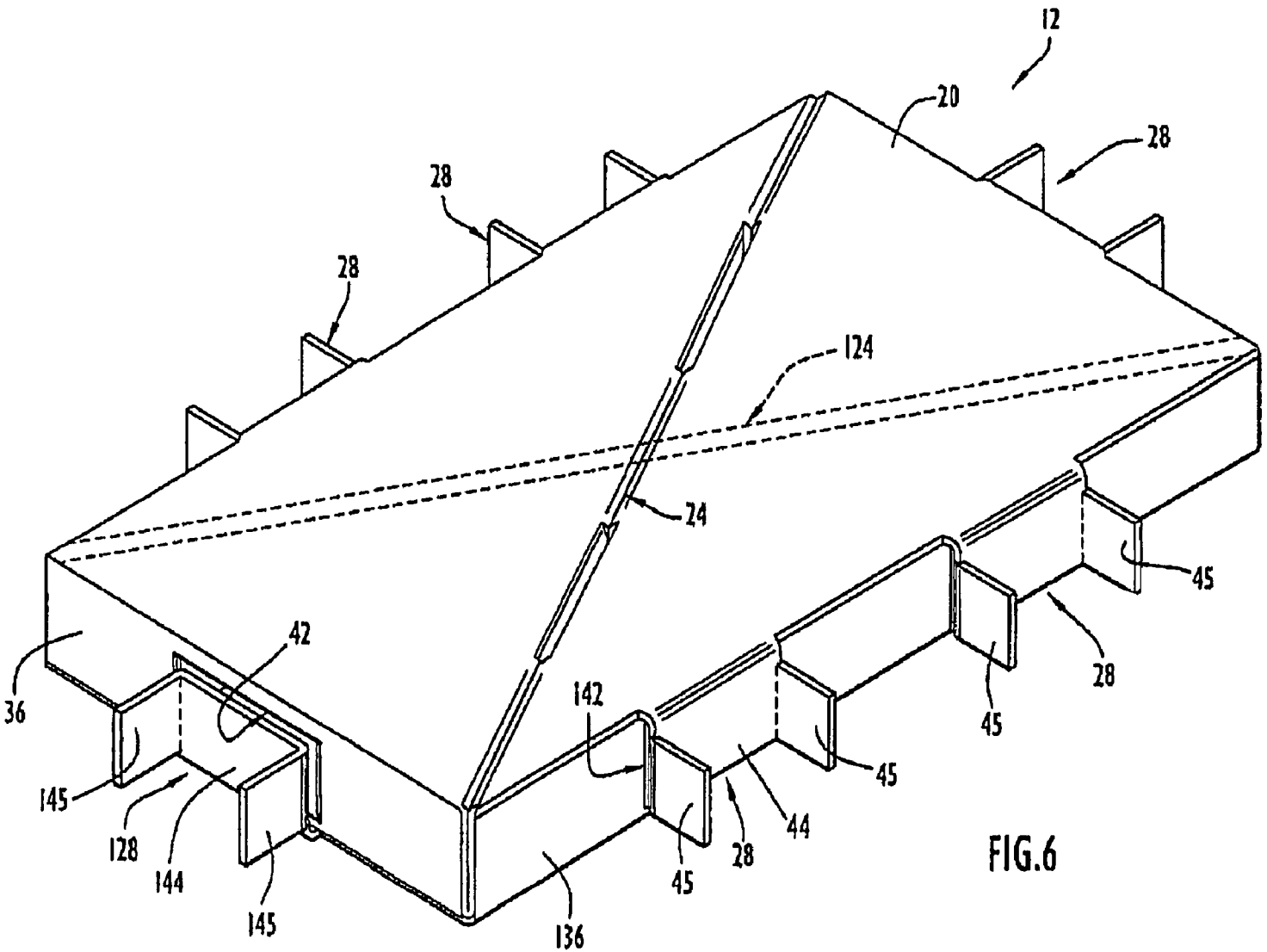
FIG. 6 is a perspective view illustrating the top and bottom members in nested relation and depicting the retention flaps of the retention elements of the top member aligned with the access openings of the bottom member and depicting the retention flap of the retention element of the bottom member aligned with the access opening of the top member.

FIGS. 5 and 6 illustrate the steps involved in foldably constructing and assembling the top and bottom members 12 and 13 to obtain the force-resisting structure 10. It should be appreciated, however, that the sequence of steps involved in foldably constructing and assembling the top and bottom members 12 and 13 into the force-resisting structure 10 can vary from the sequence of steps described herein.

FIG. 5 illustrates the force-resisting structure 10 in a partially foldably constructed condition where the top member 12 and its blank 14 and the bottom member 13 and its blank 15 are folded from their initial unfolded condition. The support rib 24 is folded downwardly from base panel 20 by folding the rib panels 48A and 48B along crest fold line 50 and base fold lines 51A and 51B so that the rib panels 48A and 48B are disposed in overlapping relation perpendicular or substantially perpendicular to base panel 20. The support rib 24 is locked in the extended position by reverse folding gate flaps 56 from rib panel 48B along their fold lines 62 and through the aligned windows 54 about 180° so that the gate flaps 56 are disposed in overlapping relation with the opposite face of rib panel 48A. The rib panel 48A will be confined between the rib panel 48B and the gate flaps 56, and the rib panels 48A and 48B and gate flaps 56 will all be disposed in parallel or substantially parallel relation. The rib panels 48A and 48B and the gate flaps 56 will also be perpendicular or substantially perpendicular to base panel 20. When the gate flaps 56 are reverse folded through the windows 54, the windows 54 are aligned with the gate flap openings 60 exposed by the gate flaps, such that the vertical support 24 and its rib panels 48A and 48B are divided into sections with spaces 65 therebetween. The locking formations 57 on the gate flaps 56 are passed through the corresponding apertures 58 in rib panel 48A and are engaged with the corresponding locking formations 59 in rib panel 48B to complete foldable construction of the support rib 24. It should be appreciated that as an alternative or in addition to the locking assembly, the support rib 24 can be fastened in the extended position using fasteners including adhesive fasteners such as glue or tape or mechanical fasteners such as staples or clips. The outer side edges of rib panels 48A and 48B meet or are adjacent one another, and the base panel 20 has a four-sided perimeter defined by side edges 21 and 22 with two pairs of diagonally opposed corners. The support rib 24 extends diagonally to base panel 20 between one pair of the diagonally opposed corners.

FIG. 5 also depicts the top member 12 with the side portion 26 folded downwardly from the base panel 20 along the fold line 32 to a position where the side wall 36 is perpendicular or substantially perpendicular to the base panel 20. FIG. 5 shows the side wall flaps 40 folded inwardly from side wall 36 into the interior of the top member so that the side wall flaps are disposed perpendicular or substantially perpendicular to base panel 20 and perpendicular or substantially perpendicular to side wall 36, thereby exposing access opening 42. The inner side edges of side wall flaps 40 may now be considered upper edges of the side wall flaps, and the outer side edges of the side wall flaps 40 may now be considered lower edges of the side wall flaps since the side wall flaps 40 extend vertically relative to the base panel 20. FIG. 5 illustrates the tuck flap 38 folded inwardly from side wall 36 along the tuck flap fold line 39 so that the tuck flap 38 is disposed parallel or substantially parallel with the base panel 20 and perpendicular or substantially perpendicular to the side wall 36, with the side wall flaps 40 disposed between the tuck flap 38 and the base panel 20.

The retention elements 28 are seen in FIG. 5 as being folded downwardly from the base panel 20 along the retention element fold lines 34 such that the retention flaps 44 are disposed perpendicular or substantially perpendicular to the base panel 20. The wings 45 of the retention elements 28 are depicted folded from their respective retention flaps 44 along the wing fold lines 46. The wings 45 of each retention element 28 are folded inwardly toward one another so that they are disposed parallel or substantially parallel to one another and perpendicular or substantially perpendicular to the retention flap 44 as well as the base panel 20. Once the wings 45 have been folded in this manner, each retention element 28 presents a perimeter along its retention flap 44 to fit within the perimeter of a corresponding access opening 142 of bottom member 13.

FIG. 5 illustrates the bottom member 13 and its blank 15 folded in a manner similar to that described above for top member 12 and its blank 14, except that the support rib 124, the side walls 136 and the retention flap 144 are folded upwardly from the base panel 120. The side wall flaps 140 and the tuck flaps 138 are folded inwardly from the side walls 136 toward the interior of the bottom member. The inner side edges of the side wall flaps 140 may now be considered lower edges of the side wall flaps, and the outer side edges of the side wall flaps 140 may now be considered upper edges of the side wall flaps. The lower edges of the side wall flaps 140 rest on the base panel 120, and the tuck flaps 138 rest on the upper edges of the side wall flaps 140. The wings 145 of retention element 128 are folded inwardly toward one another from retention flap 144 so that the retention element 128 presents a perimeter along its retention flap 144 to fit within the corresponding access opening 42 of top member 12. The support rib 124 is locked in the extended position as described above for support rib 24. The support rib 124 extends diagonal to base panel 120 and in diagonal opposition to support rib 124.

FIG. 6 depicts the top member 12 assembled over or on top of the bottom member 13 in nested relation. Assembly of the top and bottom members 12 and 13 in nested relation involves interlocking the rib slots 64 and 164 so that the crest fold line 50 of support rib 24 rests on base panel 120 and the base panel 20 rests on the crest fold line 150 of support rib 124. In addition, the tuck flap 38 of the top member rests on the base panel 120, and the base panel 20 rests on top of the tuck flaps 138. The tuck flap fold line 39 of the top member is positioned adjacent the corresponding side edge 121 of the bottom member, and the remaining side edge 21 and side edges 22 of the top member are positioned adjacent the respective tuck flap fold lines 139 of the bottom member. The tuck flap 38 of the top member is confined between the base panel 120 and the lower edges of side wall flaps 40. The tuck flaps 138 are confined between the base panel 20 and the upper edges of side wall flaps 140. The base panels 20 and 120 are parallel or substantially parallel to one another, and the side walls 36 and 136 are perpendicular or substantially perpendicular to the base panels. The side walls 36 and 136 cooperate to form or define at least a portion of a peripheral side of the force-resisting structure along the perimeters of the base panels 20,120.

The retention elements 28 and 128 are depicted in FIG. 6 aligned with the correspondingly located access openings 42, 142 in the side walls 36,136. In particular, the retention flaps 44 of the top member retention elements 28 are aligned with the corresponding access openings 142 in the side walls 136 of bottom member 13. The retention flap 144 of the bottom member retention element 128 is aligned with the corresponding access opening 42 in the side wall 36 of the top member 12. The perimeter presented by each retention element 28,128 along its retention flap 44,144 is slightly smaller than the perimeter of the access opening 42,142 and can fit within the aligned access opening.

Foldable construction and assembly of force-resisting structure 10 is completed by folding the wings 45,145 of each retention element 28,128 along their wing fold lines inwardly toward their corresponding retention flap 44,144 to define an acute angle with their corresponding retention flap as shown by arrows in FIG. 6 for one retention element 28. When the wings 45,145 are folded in this manner, the retention elements 28, 128 may be considered in a collapsed condition in which the retention elements are able to be folded into the correspondingly located access openings 42, 142. The retention elements 28,128 are then folded along their retention element fold lines relative to their base panels 20,120 toward the interior of the force-resisting structure 10, causing the retention elements to pass into the correspondingly located access openings 42,142 and into the interior of the force-resisting structure, as permitted by the collapsed condition of the retention elements. The retention elements 28 are folded along their retention element fold lines about 90° from the position shown for retention elements 28 in FIG. 6, such that the retention flaps 44 are adjacent or in abutment with the tuck flaps 138 and are parallel or substantially parallel to the base panels 20, 120. The retention element 128 is folded along its retention element fold line about 90° from the position shown for the retention element 128 in FIG. 6, such that the retention flap 144 is adjacent or in abutment with the tuck flap 38 and in parallel or substantially parallel to the base panels 20, 120. Thereafter, the wings 45,145 of the retention elements 28,128 are unfolded from their collapsed condition and are returned to a position perpendicular or substantially perpendicular to the retention flaps 44,144 as illustrated in FIG. 1. The wings 145 of the retention element 128 are unfolded from the collapsed condition by unfolding the wings 145 along their wing fold lines in opposition to one another in an upward direction. The end edges of the wings 145 may now be considered upper edges of the wings since the wings 145 extend vertically upwardly from the retention flap 144, which is disposed over the tuck flap 38. The wings 45 of each retention element 28 are unfolded in a similar manner but are unfolded along their wing fold lines in opposition to one another in a downward direction. The end edges of wings 45 may now be considered lower edges of the wings since the wings 45 extend vertically downwardly from their retention flaps 44, which are disposed beneath tuck flaps 138. Accordingly, the tuck flap 38 is snugly held between the retention flap 144 and the base panel 120 with the base panel 20 being supported on the upper edges of wings 145. The tuck flaps 138 are snugly held between the base panel 20 and the retention flap 44 with the lower edges of the wings 45 being supported on the base panel 120. The wings 45,145 are perpendicular or substantially perpendicular to the base panels 20,120 and fit between the base panels with a snug fit. The wings 45, 145 are perpendicular or substantially perpendicular to the corresponding side wall 36, 136 and overlap the side wall flaps 40, 140 of the corresponding access opening. The side wall flaps 40,140 also fit snugly between the base panels 20,120 with the tuck flaps 38,138 snugly interposed between the side wall flaps and the base panels.

The support ribs 24,124 fit snugly between the base panels 20,120, and the interlocked support ribs 24, 124 cooperatively define an interior vertical support structure having an X-shaped configuration to provide vertical support for the base panel 20 which defines an elevated top surface of the force-resisting structure 10 for supporting a load thereon. One end of the support rib 24 is confined between the ends of side walls 136 that form a corner of the force-resisting structure 10, and the other end of the support rib 24 is confined between the ends of side walls 36 and 136 that form the diagonally opposed corner of the force-resisting structure 10. The ends of support rib 124 are confined between the ends of the side walls in a similar manner but with respect to the other pair of diagonally opposed corners of the force-resisting structure 10. The access openings 42,142 in the side walls 36,136 are disposed in the peripheral side of the force-resisting structure 10 and provide communication with the interior of the force-resisting structure 10 for the insertion of a lifting mechanism, such as a pallet jack or fork of lifting equipment such as a forklift. The access openings 42,142 are situated to accommodate the lifting mechanisms of various lifting equipment, allowing the force-resisting structure 10, with a load support on its top surface, to be lifted and moved from place to place. The access openings are in linear communication with the spaces 65,165 in the support ribs 24,124 so that the lifting mechanism can be inserted a sufficient distance into the access openings and the interior of the force-resisting structure 10. The blanks 14 and 15 may be cut from the sheet material 16 so that the lines of corrugation for some or all of the blank portions, particularly the vertical support ribs, that provide vertical support for the top member base panel in supporting a load run in a vertical direction between the base panels such that loads are supported along the lines of corrugation.

Figure 7:
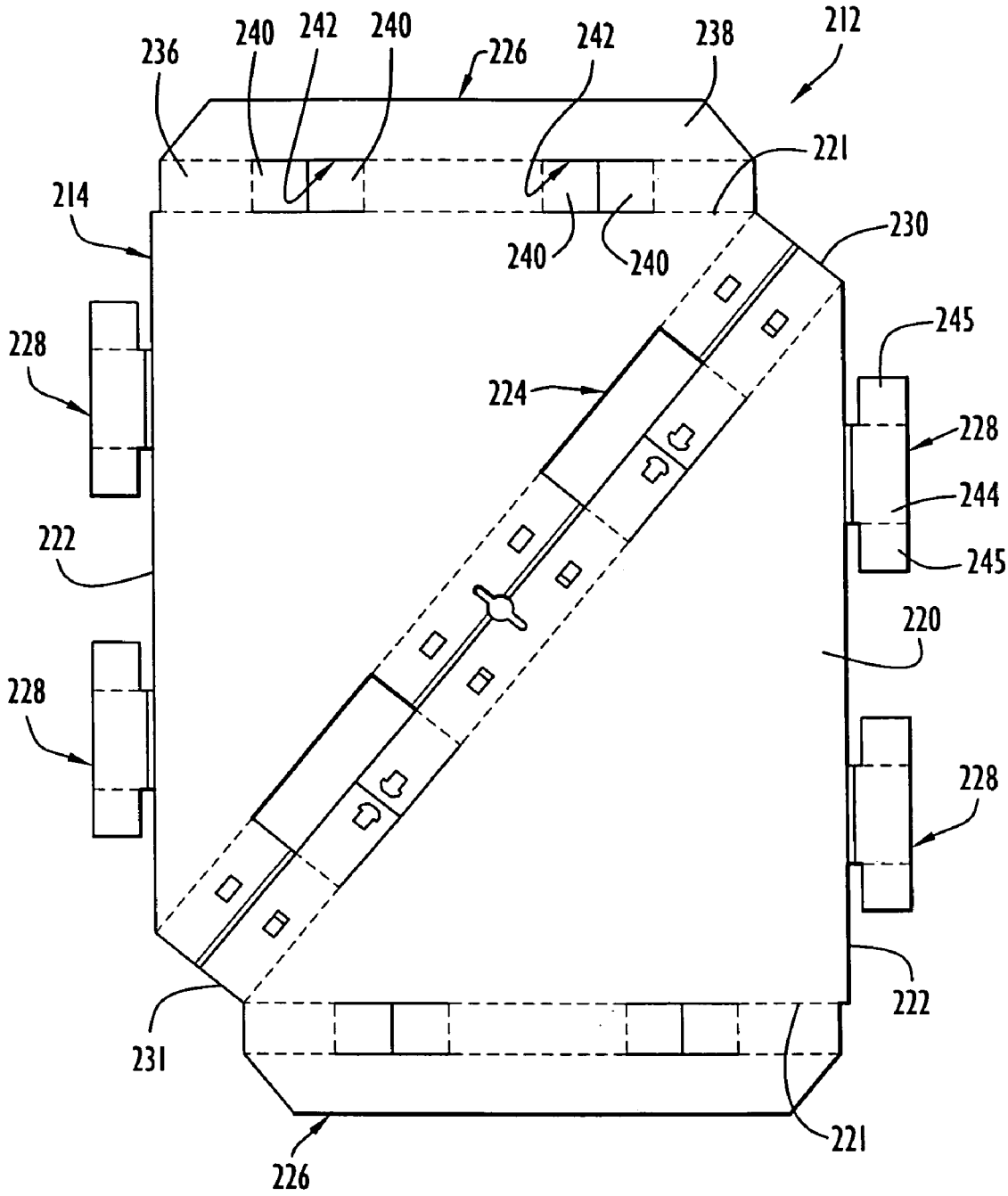
FIG. 7 is a plan view of an alternative top member prior to folding.
Figure 8:
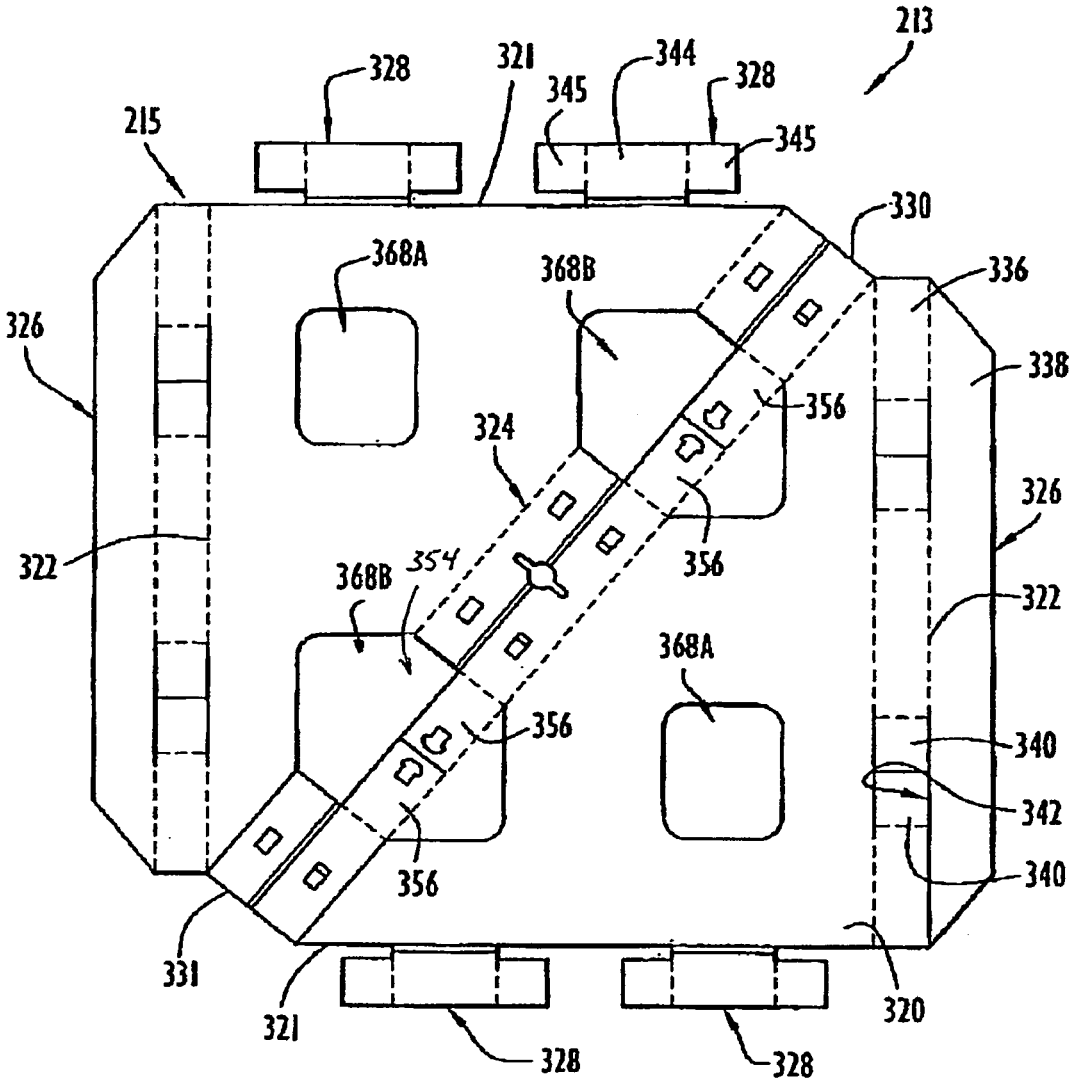
FIG. 8 is a plan view of an alternative bottom member prior to folding.
Figure 9:
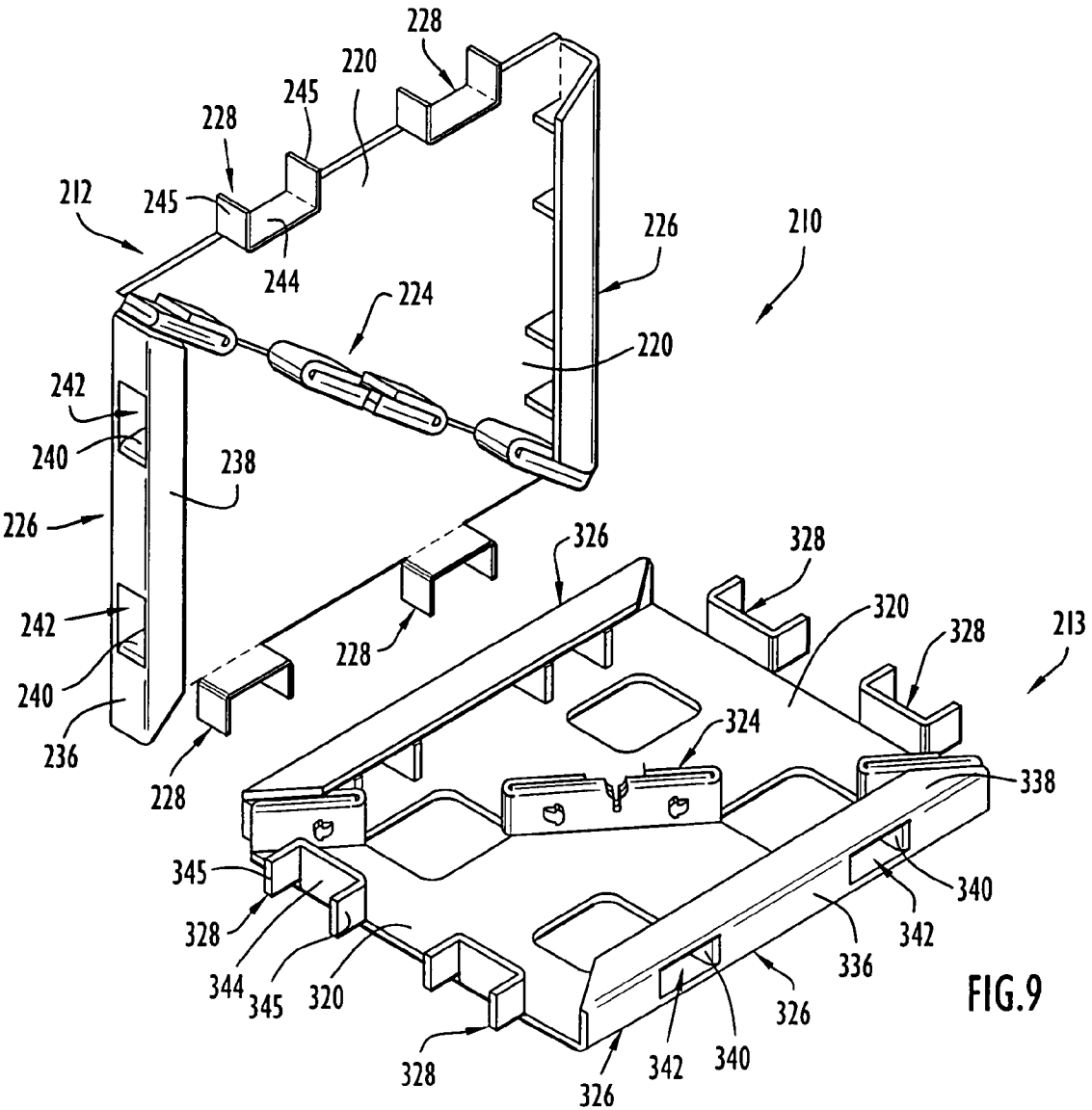
FIG. 9 is a perspective view of the top and bottom members of FIGS. 7 and 8 partially foldably constructed into an alternative foldably constructed force-resisting structure according to the present invention.

An alternative first or top member 212 is illustrated in FIG. 7 and an alternative second or bottom member 213 is illustrated in FIG. 8 prior to being foldably constructed or assembled into an alternative foldably constructed force-resisting structure 210 as depicted in FIG. 9. The top member 212 is formed of a single blank 214 of sheet material, and the bottom member 213 is formed of a single blank 215 of sheet material. The blanks 214, 215 are flat or planar in their unfolded condition. Top member 212 is essentially the same as top member 12 (see FIGS. 1-2) and comprises base panel 220 having side edges 221, 222, 230 and 231 and vertical support rib 224 which is essentially the same as the support rib 24. When the support rib 224 is folded to its extended position, the base panel 220 defines a four-sided perimeter with two diagonally opposed corners. Two retention elements 228 are foldably connected to each side edge 222 of base panel 220 as explained above for base panel 20. The top member 212 differs from the top member 12 in that a side portion 226 is foldably connected to each side edge 221 of base panel 220. The side portions 226 are essentially the same as side portion 26 (FIG. 2) and comprise a side wall 236 foldably connected to the side edge of the base panel, a tuck flap 238 foldably connected to the side wall 236, and a pair of side wall flaps 240 foldable relative to the side wall 236 to expose an access opening 242. The side portions 226 differ from side portions 26 in that the side walls 236 have two access openings 242, each associated with a pair of side wall flaps 240. The retention elements 228 are essentially the same as the retention elements 28 and comprise a retention flap 244 foldably connected to the side edge of the base panel and two wings 245 foldably connected to the retention flap 244.

The bottom member 213 is similar to the bottom member 13 and comprises base panel 320 having side edges 321, 322, 330 and 331. The bottom member 213 has a vertical support rib 324 which is essentially the same as the vertical support rib 124. Upon folding of the support rib 324 to its extended position, the base panel 320 defines a four-sided perimeter with two pairs of diagonally opposed corners. Bottom member 213 comprises side portions 326 foldably connected to base panel 320 along side edges 322, and side portions 326 are essentially the same as side portions 226. Accordingly, each side portion 326 comprises a side wall 336 foldably connected to the side edge of base panel 320, a tuck flap 338 foldably connected to the side wall 336, and two access openings in the side wall 336 each exposable by folding of two side wall flaps 340. The bottom member 213 differs from bottom member 13 in that two retention elements 328 are foldably connected to base panel 320 along each side edge 321. The retention elements 328 are essentially the same as retention elements 128 and comprise a retention flap 344 foldably connected to the side edge of base panel 320 and two wings 345 foldably connected to the retention flap. The retention elements 328 are located in correspondence with the access openings 242 of the top member 212. The access openings 342 of the bottom member 213 are located in correspondence with the retention elements 228 of the top member 212.

Bottom member 213 differs further from bottom member 13 in that base panel 320 is provided with a plurality of cut-out openings 368A and 368B. The openings 368A in base panel 320 each have the same or similar peripheral configuration, and the openings 368A are located in line with the diagonal between a pair of diagonally opposed corners of the base panel 320. In the unfolded condition for the blank 215, the openings 368B have a peripheral configuration different than that for openings 368A due to the openings 368B being bisected by the support rib 324. In particular, the window 354 and gate flaps 356 of support rib 324 are disposed within the openings 368B, and the windows 354 are continuous or in union with the openings 368B. When the support rib 324 is folded to the extended position, bisected halves of each opening 368B are brought together and each opening 368B defines a peripheral configuration that is the same or substantially the same as that for the openings 368A.

FIG. 9 depicts the top member 212 and the bottom member 213 partially foldably constructed into the alternative force-resisting structure 210. The top member 212 is shown in FIG. 9 with the support rib 224, the side portions 226, the retention elements 228 and the side wall flaps 240 all folded as described above for top member 12 in FIG. 5. The bottom member 213 is illustrated in FIG. 9 with its support rib 324, side portions 326, retention elements 328 and side wall flaps 340 all folded as described above for the bottom member 13 in FIG. 5. Foldable construction and assembly of the top and bottom members 212 and 213 into the force-resisting structure is completed by assembling the top and bottom members 212 and 213 in nested relation with the top member retention elements 228 aligned with the bottom member access openings 342 and the bottom member retention elements 328 aligned with the top member access openings 242. Thereafter, the retention elements are folded into the aligned access openings and the wings of the retention elements are placed perpendicular or substantially perpendicular between the base panels 220 and 320 as described above for the force-resisting structure 10 in connection with FIG. 6.

Figure 10:
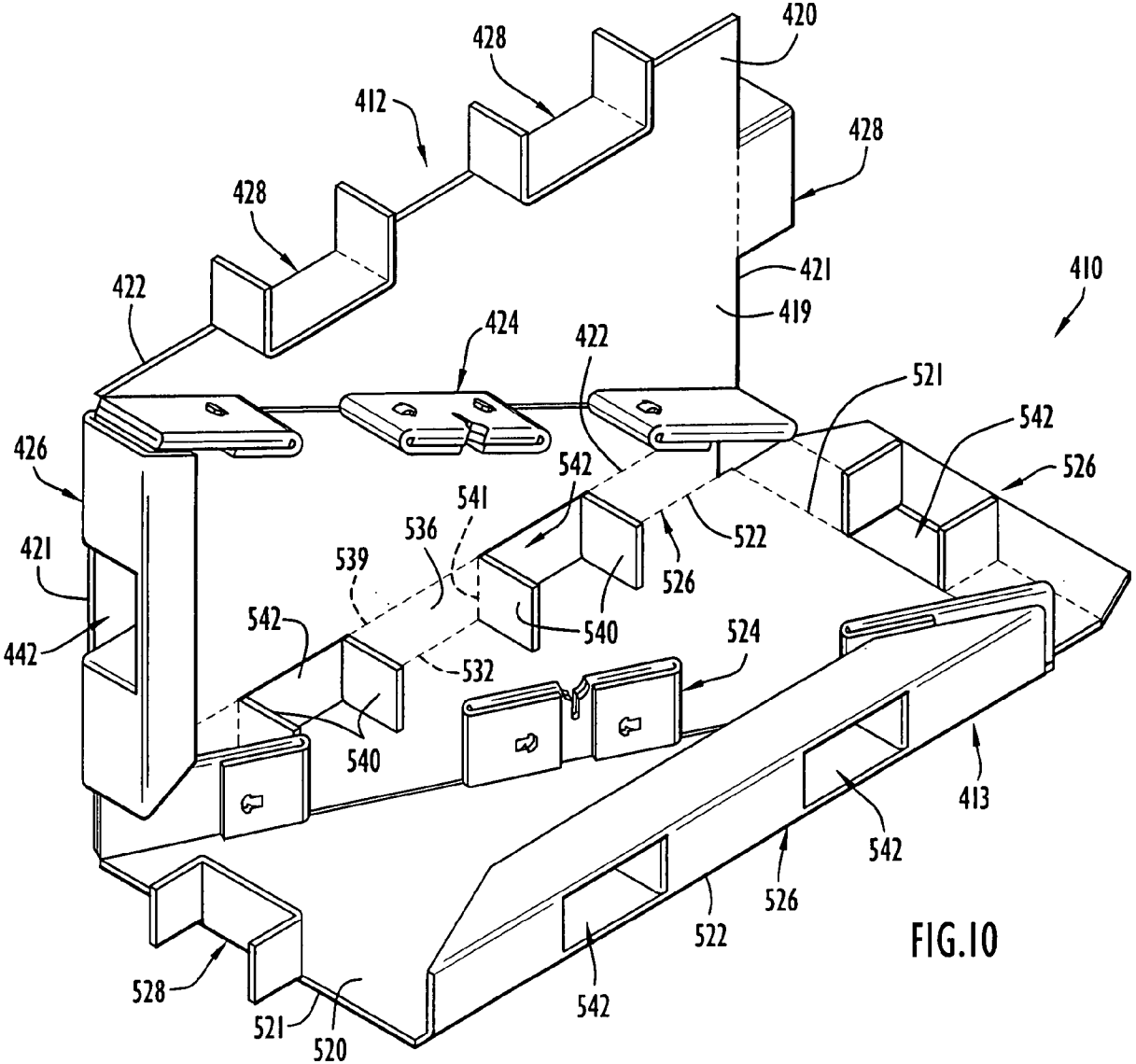
FIG. 10 is a perspective view of another alternative foldably constructed force-resisting structure according to the present invention in a partially foldably constructed condition.

FIG. 10 illustrates another alternative force-resisting structure 410 in a partially foldably constructed condition. The top member 412 and the bottom member 413 for the force-resisting structure 410 are formed together as a single blank 419 of sheet material. The blank 419 that forms both the top member 412 and the bottom member 413 is formed integrally and unitarily or monolithically as one piece and is flat or planar prior to folding. The top member 412 is similar to the top member 12 and has support rib 424 folded from its base panel 420 to an extended position, has a side portion 426 along one side edge 421, has a retention element 428 along the other side edge 421, and has two retention elements 428 along one side edge 422. The support rib 424, the side portion 426 and the retention elements 428 are similar to the support rib 24, the side portion 26 and the retention elements 28 described above for top member 12. The top member 412 differs from the top member 12 in that the remaining side edge 422 of base panel 420 is directly foldably connected to a side wall of bottom member 413.

The bottom member 413 is similar to bottom member 13 (see FIG. 3) and comprises a support rib 524 folded from its base panel 520 to an extended position, a side portion 526 along the side edge 521 corresponding to the side edge 421 having retention element 428, a retention element 528 along the opposite side edge 521, and a side portion 526 along the side edge 522. The support rib 524, the side portions 526 and the retention element 528 are similar to the support rib 124, side portions 126 and the retention element 128 (also as shown in FIG. 31. The remaining side edge 522 of base panel 520 is foldably connected to a side portion 526 that includes a side wall 536 without a tuck flap. The side wall 536 of this side portion 526 is foldably connected to the base panel 520 by an inner side wall fold line 532 and is foldably connected to the side edge 422 of the top member base panel 420 by an outer side wall fold line 539. Side wall 536 to which the top member base panel 420 is foldably connected includes two access openings 542 each associated with a pair of side wall flaps 540 foldable along fold line 547. Retention elements 428 of the top member are located in correspondence with access openings 542 of the bottom member, and the retention element 528 of the bottom member is located in correspondence with an access opening 442 of the top member.

The top and bottom members 412 and 413 are placed in nested relation by folding the top member base panel 420 along the outer side wall fold line 539 that foldably connects it to the side wall 536. The base panel 420 is folded downwardly toward the bottom member 413 to be disposed in parallel or substantially parallel relation with the base panel 520. When the base panel 420 is folded downwardly over the bottom member 413, the support rib 424 lockingly engages the support rib 524 by engagement of their respective rib slots such that the support ribs 424 and 524 form an X-shaped support rib structure in the interior of the force-resisting structure 410. The top and bottom members 412 and 413 are interlocked in nested relation by folding the retention elements 428,528 into the corresponding access openings 442, 542 as already described above.

Figure 11:
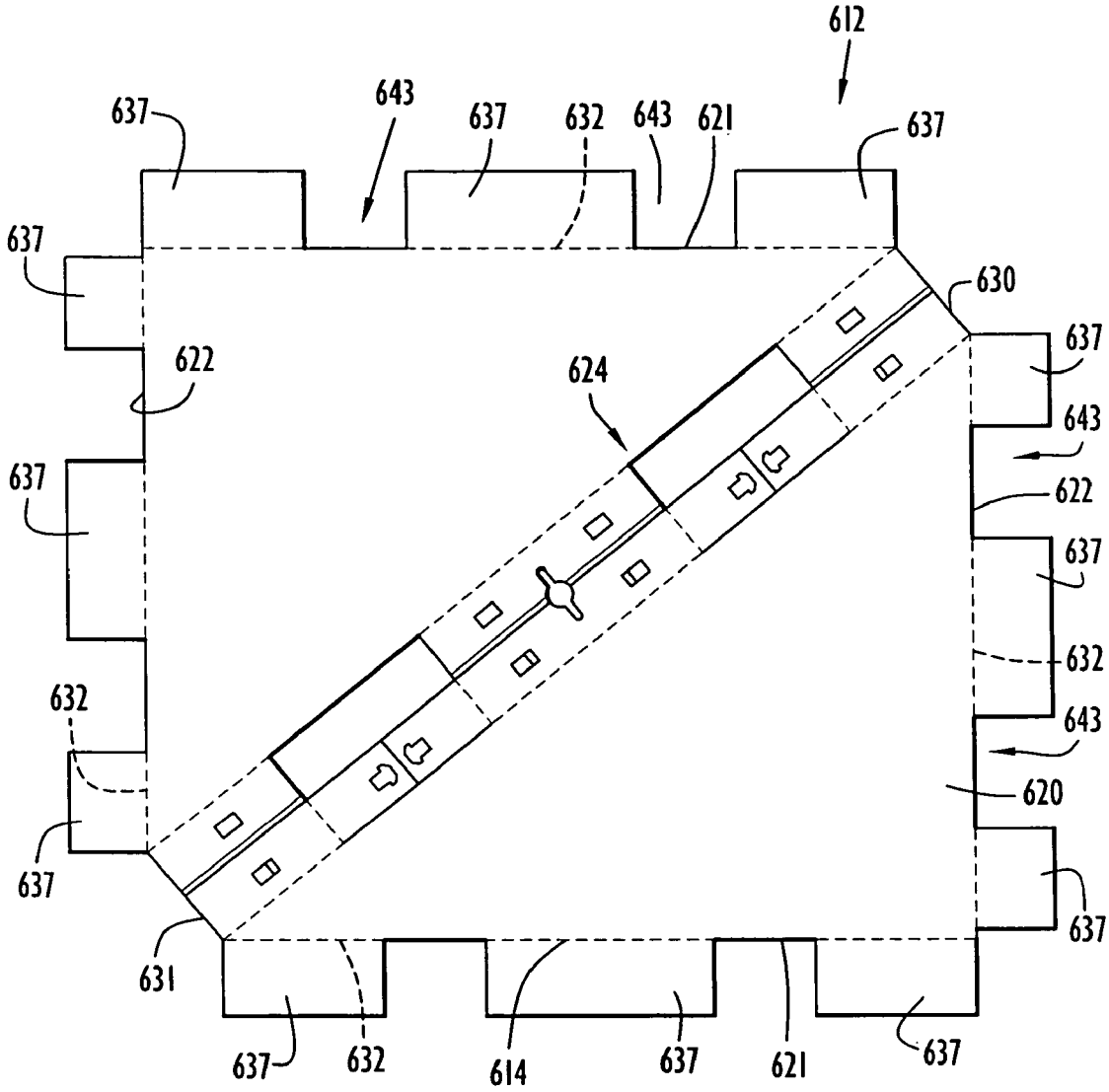
FIG. 11 is a plan view of yet another alternative top member prior to folding.
Figure 12:
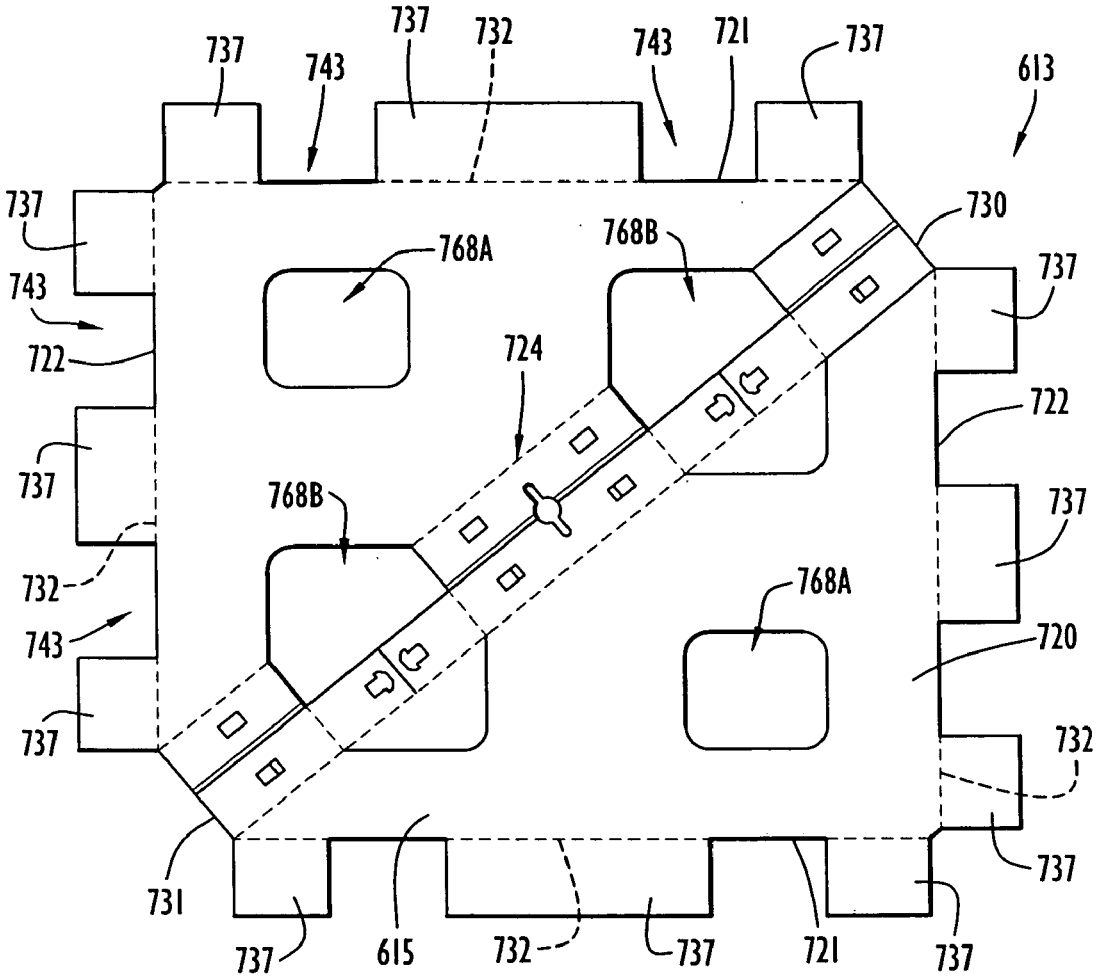
FIG. 12 is a plan view of yet another alternative bottom member prior to folding.
Figure 13:
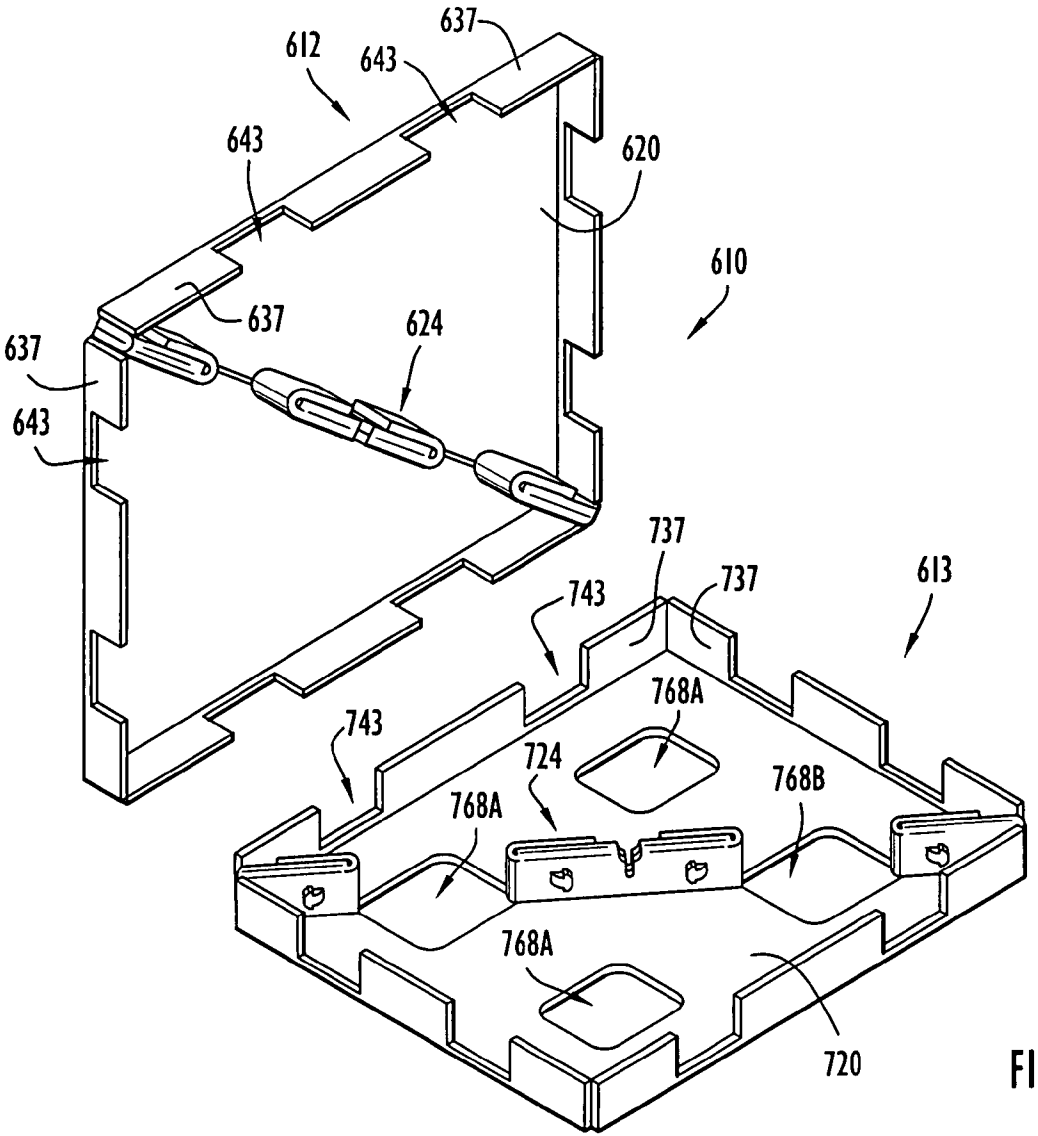
FIG. 13 is a perspective view of the top and bottom members of FIGS. 11 and 12 partially foldably constructed into yet another alternative foldably constructed force-resisting structure according to the present invention.

Yet another alternative top member 612 and yet another alternative bottom member 613 are respectively depicted in FIGS. 11 and 12 prior to being foldably constructed and assembled into yet another alternative force-resisting structure 610 depicted in FIG. 13. The top member 613 is formed of a single blank 614 of sheet material form integrally or unitarily or monolithically as one piece. The bottom member 613 is formed from a blank 615 of sheet material similarly formed integrally and unitarily or monolithically as one piece. The blanks 614 and 615 are flat or planar prior to folding. The top member 612 comprises base panel 620 with side edges 621, 622, 630 and 631, and support rib 624 similar to base panel 20. When the support rib 624 is folded to its extended position, the perimeter of base panel 620 is four-sided with two pairs of diagonally opposed corners. The top member 612 differs from the top member 12 in that the top member 612 is provided with different side portions and without retention elements. The side portion disposed along each side edge 621 and 622 of base panel 620 is composed of a plurality of side wall segments 637 separated by spaces 643. Each side wall segment 637 is foldably connected to the corresponding side edge of base panel 620 by a side wall fold line 632. The plurality of side wall segments 637 along each side edge 621 and 622 includes a central side wall segment located between two outer side wall segments. The outer side wall segments are disposed at the ends of the base panel side edges to form diagonally opposed corners along the peripheral side of the force-resisting structure 610 upon foldable construction of top member 612.

Bottom member 613 has a base panel 720 similar to the base panel 320 of bottom member 213 in that the base panel 720 has side edges 721, 722, 730 and 731, support rib 724, and cut-out openings 768A and 768B. The bottom member 613 is similar to the top member 612 in that a side portion is associated with each side edge 721 and 722 of base panel 720 comprising side wall segments 737 separated by spaces 743. Each side wall segment 737 is foldable from the base panel 720 along a side wall fold line 732 that foldably connects the side wall segment 737 to the base panel 720.

In order to foldably construct and assemble the top and bottom members 612 and 613 into the force-resisting structure 610, the vertical support ribs 624 and 724 are folded to their extended positions, the side wall segments 637 of the top member 612 are folded along their respective fold lines 632 downwardly from base panel 620, and the side wall segments 737 are folded along their fold lines 732 upwardly from the base panel 720. The side wall segments 637 and 737 are folded relative to their base panels to a position perpendicular or substantially perpendicular to their base panels. The side wall segments 637 of top member 612 define a peripheral side wall along the perimeter of base panel 620 with two pairs of diagonally opposed corners and with spaces 643 therein. The side wall segments 737 of bottom member 613 define a peripheral side wall along the perimeter of base panel 720 with two pairs of diagonally opposed corners and with spaces 743 therein. The peripheral side wall defined by the side wall segments 637 of top member 612 is slightly or somewhat larger in peripheral size than the peripheral side wall defined by the side wall segments 737 of bottom member 613 so that the top member 612 can be placed over the bottom member 613 in close nested relation, with the side wall segments 637 exteriorly overlapping corresponding side wall segments 737 and the openings 643 aligned with corresponding openings 743. The top and bottom members 612 and 613 can be fastened in nested relation in any suitable manner including the interlocking arrangement illustrated in FIG. 18. In addition or alternative to the locking arrangement of FIG. 18, extraneous fasteners, including adhesive fasteners such as tape or glue and mechanical fasteners such as staples and clips, can be used to fasten the top and bottom members together such as by fastening together overlapping side wall segments 637, 737. Each pair of aligned spaces 643, 743 defines an access opening in the peripheral side of the force-resisting structure 610 providing communication with the interior for insertion of a lifting mechanism. It should be appreciated that the top and bottom members 612 and 613 can be assembled in nested relation with the peripheral side wall of the top member disposed interiorly of the peripheral side wall of the bottom member.

Figure 14:
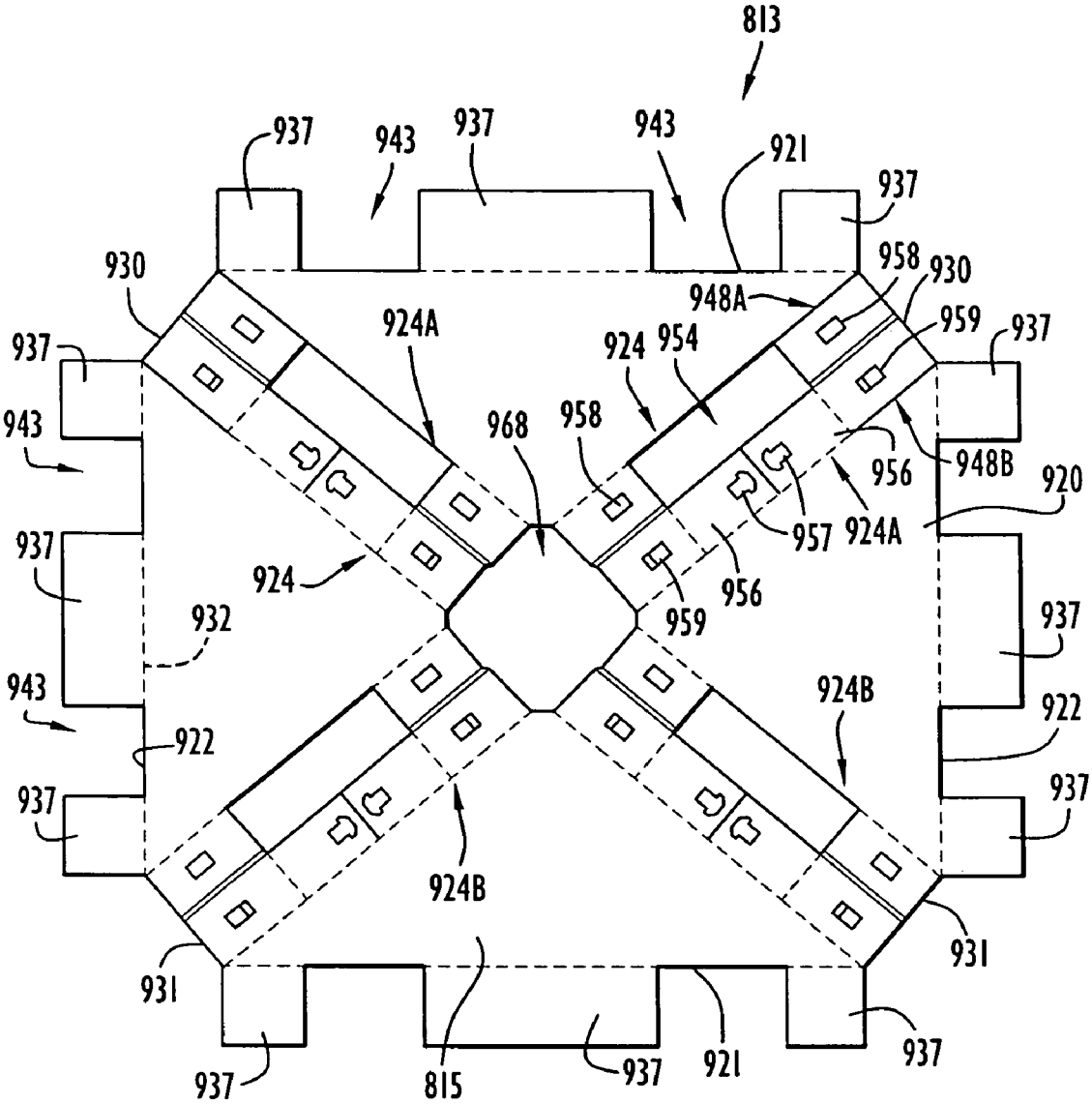
FIG. 14 is a plan view of a further alternative bottom member prior to folding.

A further alternative bottom member 813 formed of a one piece bank 815 is shown in FIG. 14 and is similar to bottom member 613 in that the bottom member 813 comprises a base panel 920 and a plurality of side wall segments 937 foldably connected to each of the side edges 921 and 922 of base panel 920 along a side wall fold line 932. The side wall segments 937 along each side edge 921 and 922 of base panel 920 are separated from one another by spaces 943. The bottom member 813 differs from the bottom members previously described in that the bottom member 813 comprises two interior vertical support ribs 924 in base panel 920 extending in diagonal opposition to one another in an X-shaped arrangement. Accordingly, prior to folding, the base panel 920 has two canted side edges 930 and two canted side edges 931, with one support rib 924 extending diagonally between one pair of diagonally opposed canted side edges 930, 931 and the other support rib 924 extending diagonally between the other pair of diagonally opposed canted side edges 930, 931. A cut-out opening 968 is centrally located in base panel 920 and divides or separates each support rib 924 into two support ribs or support rib sections 924A and 924B. The support rib sections 924A extend from the opening 968 to the respective canted side edges 930. The support rib sections 924B extend from the opening 968 to the respective canted side edges 931. Each support rib section 924A, 924B has its own locking assembly including a window 954 in the rib panel 948A, a pair of gate flaps 956 in the rib panel 948B, locking formations 957 on the gate flaps, pass-through apertures 958 in the rib panel 948A and locking formations 959 in the rib panel 948B.

Figure 15:
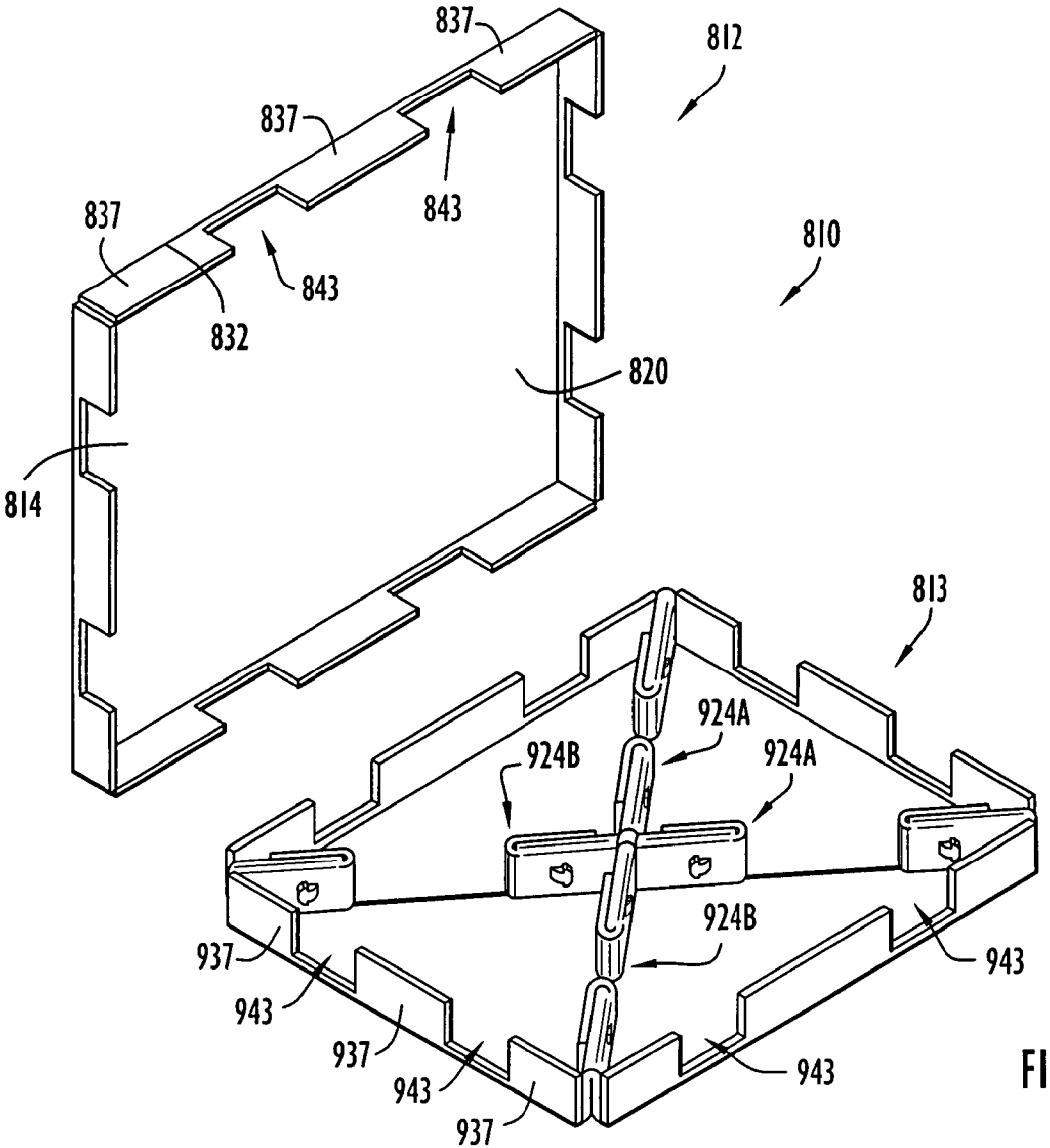
FIG. 15 is a perspective view of the bottom member of FIG. 14 and a further alternative top member partially foldably constructed into a further alternative foldably constructed force-resisting structure according to the present invention.

The bottom member 813 is foldably constructed as illustrated in FIG. 15 by folding each support rib section 924A and 924B to the extended position and locking the support rib section in its extended position via the locking assembly as explained above. Each side wall segment 937 is folded upwardly from the base panel 920 to define a peripheral side wall along the perimeter of base panel 920. The support ribs 924 cooperate to form a support rib structure having an X-shape within the interior of bottom member 813, with the support ribs 924 extending in diagonal opposition to one another. When the rib sections 924A and 924B are folded to their extended position, the central opening 968 collapses such that the inner ends of the support rib sections 924A and 924B along the perimeter edges of opening 968 meet at the center of the base panel 920. The outer ends of the support rib sections 924A and 924B are confined between the ends of the side wall segments 937 that meet or are adjacent one another at the corners of the bottom member.

Since the X-shaped vertical support rib structure is formed entirely from support ribs of the bottom member 813, the top member 812 assembled to bottom member 813 is provided without any vertical support ribs. Accordingly, the top member 812 comprises a blank 814 including a base panel 820 and side wall segments 837 separated by spaces 843 formed by folding along side wall fold lines 832 in the same manner as described above for top member 612 (see FIG. 11). The top member 812 is essentially the same as the top member 612 but without the vertical support rib. The top member 812 is assembled in nested relation with the bottom member 813 with the side wall segments 837 overlapping the side wall segments 937 and with the spaces 843 aligned with the spaces 943 so that each pair of aligned spaces 843, 943 forms an access opening in the peripheral side of the force-resisting structure 810 as described above for force-resisting structure 610 (see FIG. 11).

Figure 16:
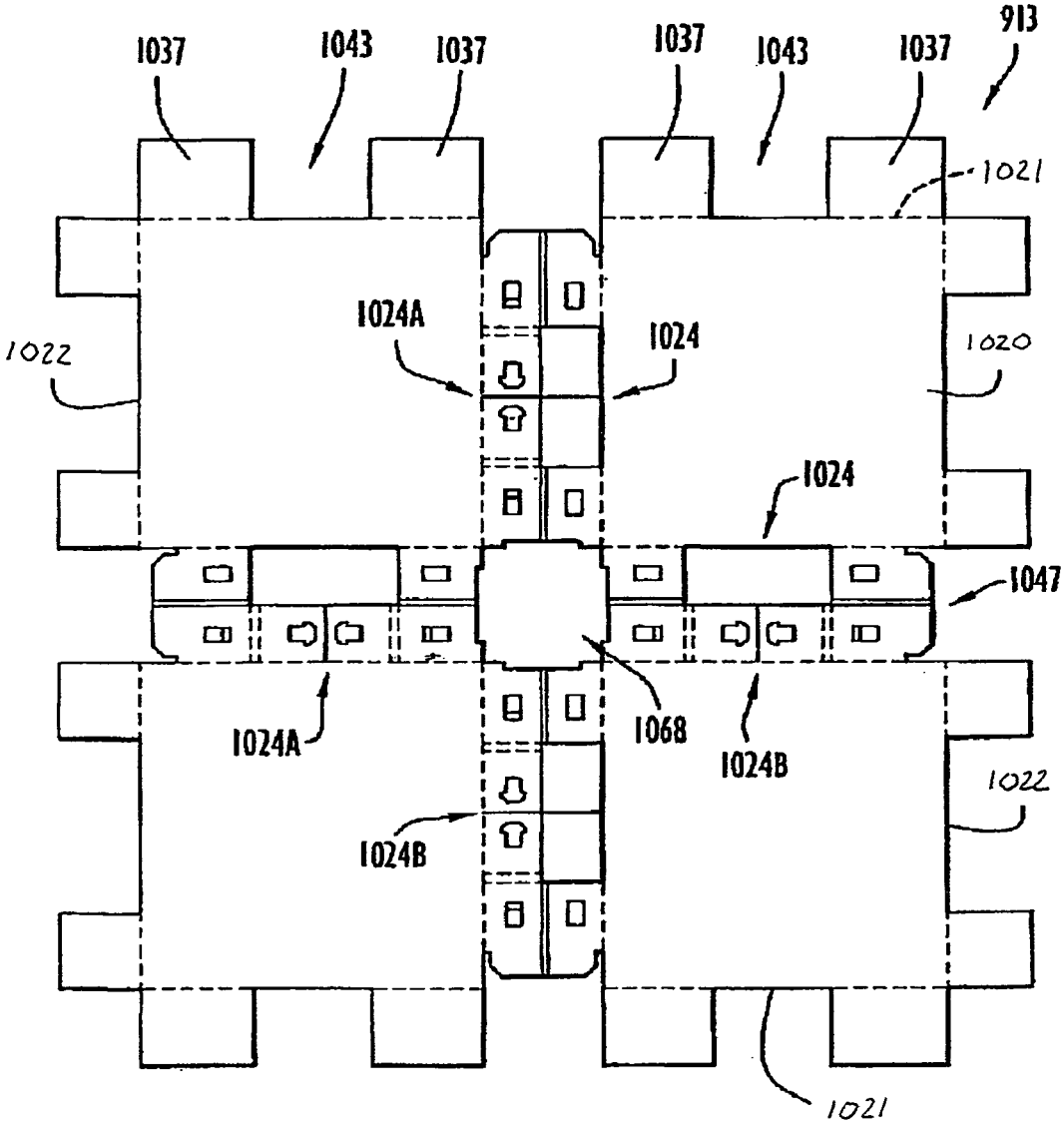
FIG. 16 is a plan view of an additional alternative bottom member prior to folding.
Figure 17:
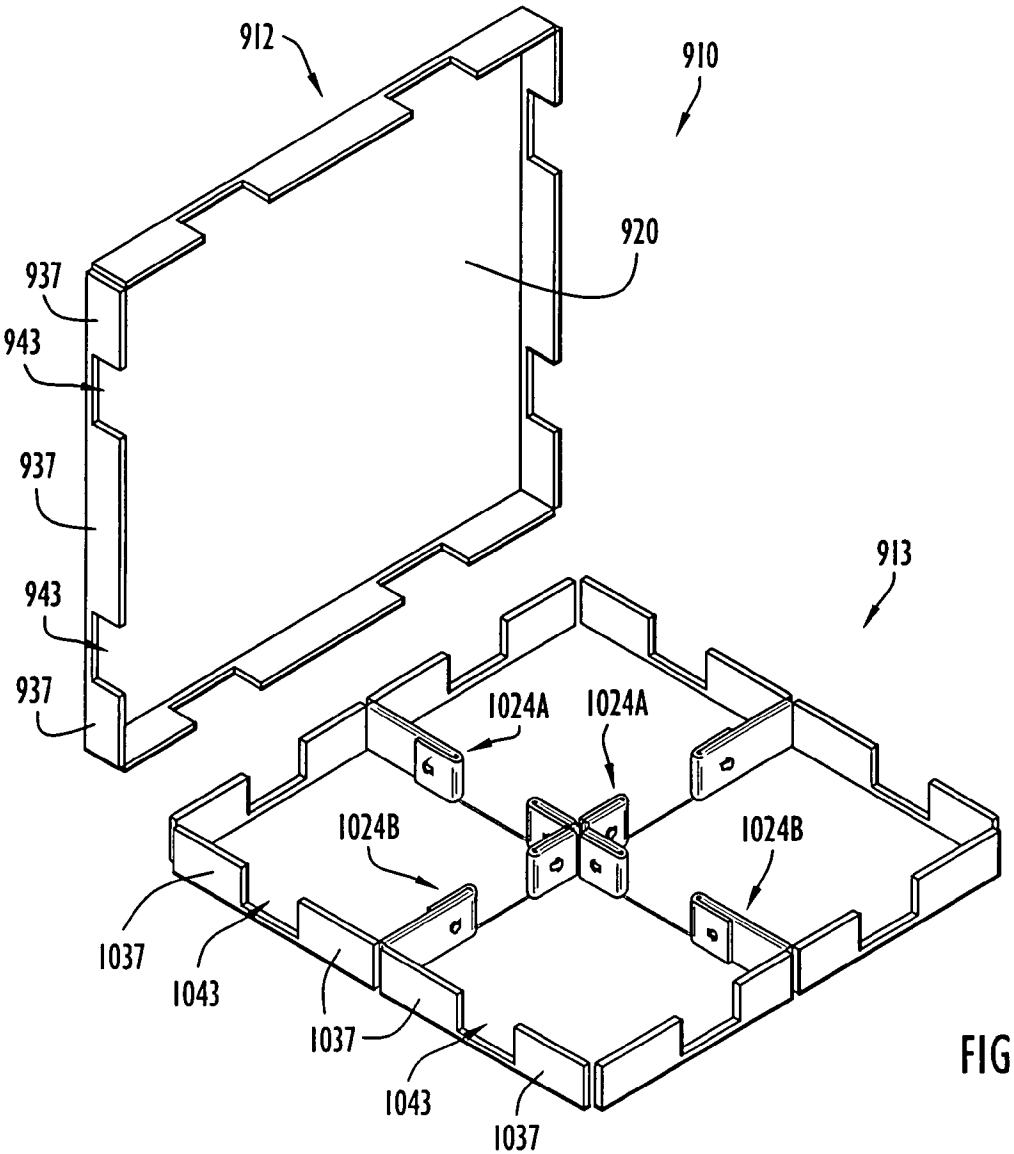
FIG. 17 is a perspective view of the bottom member of FIG. 16 and the top member of FIG. 15 partially foldably constructed into an additional alternative foldably constructed force-resisting structure according to the present invention.

An additional alternative bottom member 913 is illustrated in FIG. 16 and is similar to bottom member 813 (see FIG. 15) except that the support ribs 1024 in the base panel 1020 of bottom member 913 are arranged perpendicular or at a 90° angle to one another in a cross-shaped arrangement, Also, the support ribs 1024 are perpendicular to side edges 1021 and 1022 of base panel 1020 as opposed to extending diagonally between corners of the base panel (see FIG. 15). One support rib 1024 of bottom member 913 extends perpendicular to side edges 1021 and the other support rib 1024 of bottom member 913 extends perpendicular to side edges 1022. A cut-out opening 1068 centrally located in base panel 920 1020 divides or separates each support rib 1024 into two support ribs or support rib sections 1024A and 1024B. Each support rib section 1024A and 1024B has its own locking assembly as described above for support rib sections 924A and 924B (see FIG. 15). When the support rib sections 1024A and 1024B are folded to their extended position as seen in FIG. 17, the central opening 1068 collapses and the inner ends of the support rib sections 1024A and 1024B defined by the peripheral edge of opening 1068 meet or are adjacent one another at the center of base panel 920 1020. In addition, central side wall segments 1037 spaced along each side edge 1021 and 1022 of base panel 1020 are spaced from one another by the corresponding support rib section 1024A, 1024B prior to folding and, subsequent to the rib sections being folded to their extended position, the outer ends of the support rib sections 1024A, 1024B are confined between the ends of the central side wall segments 1037 which are brought into adjacent relation as shown in FIG. 17. In order to form the force-resisting structure 910, the bottom member 913 is assembled to a top member 912 which is essentially the same as the top member 812 (FIG. 15) and the component parts thereof are therefore designated by the same reference numerals. When the top and bottom members 912 and 913 are asembled in nested relation, the side wall sections 1037 of the top member 912 are in overlapping relation with the side wall sections 1037 of the bottom member 913 and the openings 843 in the top member 912 are aligned with the openings 1043 in the bottom member 913, each pair of aligned openings 843, 1043 forming an access opening in the peripheral side of the force-resisting structure 910

Figure 18:
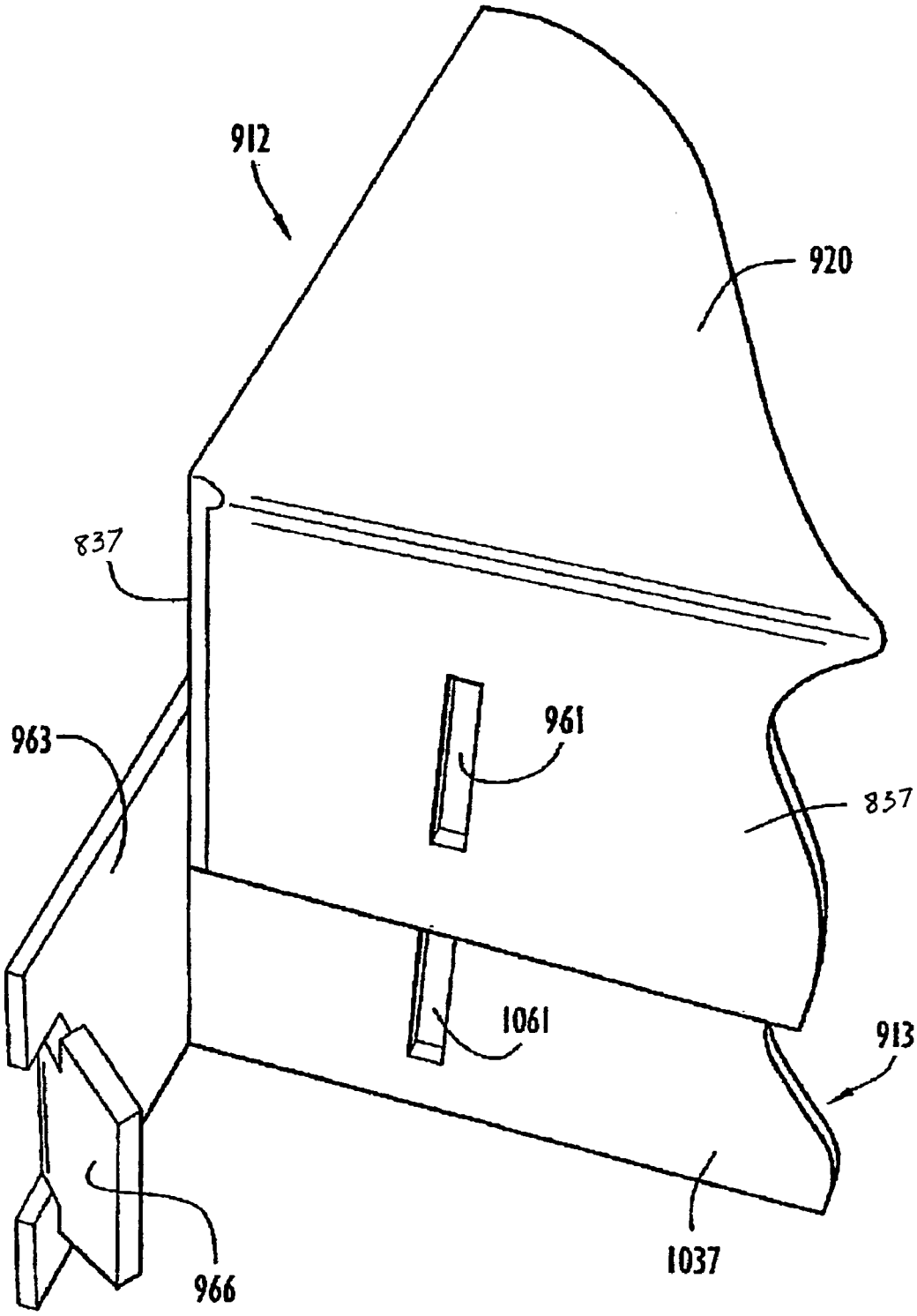
FIG. 18 is a broken perspective view of an interlocking arrangement for the peripheral side walls of the force-resisting structures.

FIG. 18 illustrates a locking arrangement by which overlapping side walls of the top and bottom members can be interlocked using the initial blanks themselves. The locking arrangement is depicted in FIG. 18 in conjunction with the overlapping side wall segments 837, 1037 at corners of the top member 912 and bottom member 913 as they are assembled in nested relation to form the force-resisting structure 910 (FIG. 17). The side wall segment 837 which meets or is adjacent another side wall segment 837 at a corner of the top member 912 is provided with a locking slot 961. The corresponding side wall segment 1037 of bottom member 913 which meets or is adjacent another side wall segment 1037 at a corner of bottom member 913 is provided with a locking slot 1061 which is aligned with the locking slot 961 when the top member 912 is assembled in nested relation over the bottom member 913. A locking strap 963 formed from the top member blank and foldably connected to the end of side wall segment 837 is folded around the corner of the peripheral side wall of top member 912 and a locking tab 966 on the strap 963 can be inserted into the aligned locking slots 961 and 1061. It should be appreciated that the locking arrangement can be used to interlock various overlapping side walls of the top and bottom members at the corners or at other locations along the side walls.

In the force-resisting structures, the top and bottom members can be interlocked in nested, assembled relation due to the interlocking relationship between portions of the top and bottom members themselves, i.e. the initial blanks themselves, without the need for extraneous fasteners. Structural strength, rigidity and integrity, including increased torsional strength and load support strength, are enhanced in the force-resisting structures because the portions of the top and bottom members that interlock, secure or are secured to other portions, and/or provide vertical support for the top member base panel are formed out of the initial blanks of sheet material and remain integral with the blanks. Structural strength, rigidity and integrity, including torsional strength and load support strength, are also enhanced in the force-resisting structures due to the snug fit of the wings, the side wall flaps and/or the vertical support ribs in the interior of the force-resisting structures. The vertical support ribs form X-shaped or cross-shaped vertical support structures within the interiors of the force-resisting structures for enhanced load support strength. The X-shaped or cross-shaped vertical support structures can be formed by interlocking top and bottom member support ribs or by support ribs provided in either the top or bottom member. The support ribs can extend in diagonal opposition to one another or perpendicularly to one another. The support ribs can extend diagonally between diagonally opposed corners of the force-resisting structures or perpendicularly to peripheral sides of the force-resisting structures. The force-resisting structures can be designed so that loads are supported along the lines of corrugation of the sheet material for greater strength, rigidity and integrity, including greater torsional strength and load support strength. The side wall flaps and/or the wings can be arranged to provide vertical support entirely around the perimeter of the force-resisting structures to resist deflection of the top member base panel. The side portions of the top and bottom members may include side walls, with or without tuck flaps, and/or retention elements. The side walls may be continuous side walls or side wall segments separated by spaces. The side walls of the bottom members can fit interiorly of side walls of the top members when the top and bottom members are in nested relation. Alternatively, the side walls of the top members can fit interiorly of the side walls of the bottom members in nested relation. The side walls of the top and bottom members can be secured in overlapping relation, and a locking arrangement formed from the initial blank can be used to interlockingly secure overlapping side walls especially at the corners of the force-resisting structures. The top and bottom members can be easily manufactured and can be shipped and/or stored in the unfolded condition in which the top and bottom members occupy minimal space due to their flat or planar configuration. The force-resisting structures can be disassembled or broken down for return to the unfolded condition subsequent to use. The force-resisting structures are readily and easily recyclable or disposable. Accordingly, the force-resisting structures minimize adverse environmental impact, occupy minimal space prior to and/or subsequent to assembly, and effectively save in production, storage and transportation costs. The force-resisting structures are especially well suited for use as a pallet or as a dunnage support.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A foldably constructed force-resisting structure comprising:

a top member formed from a top member base panel having a perimeter comprising a plurality of side edges and two diagonally opposed corners, a top member side portion foldably connected to one of said side edges at a side portion fold line, and a top member interior support rib comprising a pair of rib panels having inner side edges interconnected at a crest fold line and outer side edges connected to said top member base panel at respective base fold lines, the crest fold line extending between the diagonally opposed corners of said top member base panel, the rib panels being folded into overlapping relation substantially perpendicular to said top member base panel with the base fold lines adjacent one another, the top member side portion being folded to a position substantially perpendicular to said top member base panel;

a bottom member formed from a bottom member base panel having a perimeter comprising a plurality of side edges and two diagonally opposed corners, a bottom member side portion foldably connected to one of said side edges of said bottom member base panel at a side portion fold line, and a bottom member interior support rib comprising a pair of rib panels having inner side edges interconnected at a crest fold line and outer side edges connected to said bottom member base panel at respective base fold lines, the crest fold line extending between the diagonally opposed corners of said bottom member base panel, the rib panels of said bottom member interior support rib being folded into overlapping relation and substantially perpendicular to said bottom member base panel with the base fold lines of said bottom member interior support rib adjacent one another, the bottom member side portion being folded to a position substantially perpendicular to said bottom member base panel; and said bottom member being assembled to said top member in nested relation, said support ribs in interlocking relation defining an X-shaped support structure disposed between said base panels, and said top member base panel supported on said X-shaped support structure , said top member and said bottom member defining a peripheral side of said force-resisting structure along said perimeters of said base panels and defined at least in part by the side portions, said top member and said bottom member defining an interior between said base panels, said peripheral side of said force-resisting structure having an opening therein providing access to the interior.

2. The foldably constructed force-resisting structure recited in claim 1 wherein said access opening is provided in said side portion of either said top member or said bottom member, and said base panel of the other of said top member or said bottom member includes a retention element folded therefrom to interlockingly engage said access opening to secure said side portion to said other of said top member or said bottom member.

3. The foldably constructed force-resisting structure recited in claim 1 wherein said top member support rib comprises a top member rib slot and said bottom member support rib comprises a bottom member rib slot engaged with said top member rib slot to interlockingly secure said top member support rib to said bottom member support rib when said top member and said bottom member are assembled in nested relation.

4. The foldably constructed force-resisting structure recited in claim 1 wherein each of said support ribs comprises a locking assembly for locking said support rib in said extended position.

5. The foldably constructed force-resisting structure recited in claim 4 wherein said locking assembly for each said support rib comprises a window and a pass-through aperture in one of said rib panels of said support rib, at least one gate flap foldably connected to the other of said rib panels of said support rib, a locking formation on said gate flap, and a locking formation on said other of said rib panels cooperatively engageable with said locking formation, said gate flap being reverse folded through said window when said support rib is in said extended position, said locking formation on said gate flap being inserted through said pass-through aperture and into cooperative engagement with said locking formation on said other of said rib panels to lock said support rib in said extended position.

6. The foldably constructed force-resisting structure recited in claim 1 wherein said sheet material is corrugated paperboard.

7. The foldably constructed force-resisting structure recited in claim 1 wherein said blank of said top member is a one-piece blank and said blank of said bottom member is a one-piece blank formed separately from said blank of said top member.

8. The foldably constructed force-resisting structure recited in claim 1 wherein said blank of said top member and said blank of said bottom member are formed together as one piece.

* * * * *